United States Patent [19]

Kasamura et al.

[11] Patent Number: 4,941,018

[45] Date of Patent: Jul. 10, 1990

[54] DEVELOPING DEVICE ACCOMMODATING APPARATUS AND IMAGE FORMING APPARATUS AND DEVELOPING DEVICE

[75] Inventors: Toshirou Kasamura, Yokohama; Masashi Ohashi; Toshihiko Kusumoto, both of Tokyo; Naoki Okuda, Kawasaki; Nobukazu Sasaki, Yokohama; Yasunori Maeda, Inagi; Akiyoshi Kimura, Kawasaki; Katsumi Munenaka, Tokyo; Yoshikuni Toyama, Yokohama; Minoru Nada; Ken Tanabe, both of Kawasaki; Masamichi Ikeda; Yasuhide Hishikawa, both of Yokohama; Takashi Ozawa, Ichikawa, all of Japan

[73] Assignee: Canon Kabushiki Kaisha, Tokyo, Japan

[21] Appl. No.: 289,521

[22] Filed: Dec. 27, 1988

Related U.S. Application Data

[63] Continuation of Ser. No. 217,078, Jul. 8, 1988, abandoned, which is a continuation of Ser. No. 111,761, Oct. 23, 1987, abandoned.

[51] Int. Cl.[5] ..... G03G 15/01

[52] U.S. Cl. ..... 355/245; 355/326

[58] Field of Search ..... 355/3 DD, 14 D; 118/645; 335/245, 326–328

[56] References Cited

U.S. PATENT DOCUMENTS

| | | | |
|---|---|---|---|
| 3,609,029 | 9/1971 | Egnaczak | 355/4 X |
| 3,958,876 | 5/1976 | Terashima | 355/4 |
| 4,014,608 | 3/1977 | Terashima | 355/4 |
| 4,542,979 | 9/1985 | Percic | 355/4 |
| 4,705,394 | 11/1987 | Watanabe | 355/300 |

FOREIGN PATENT DOCUMENTS

| | | | |
|---|---|---|---|
| 57-204566 | 12/1982 | Japan | 355/4 |
| 57-204567 | 12/1982 | Japan | 355/4 |
| 2153301A | 8/1985 | United Kingdom . | |

*Primary Examiner*—Joan H. Pendegrass

*Attorney, Agent, or Firm*—Fitzpatrick, Cella, Harper & Scinto

[57] ABSTRACT

An image forming apparatus includes an image bearing member, image forming station for forming a latent image on the image bearing member, a conveying passage extending toward the image bearing member to guide a developing device, a first moving mechanism for engaging with the developing device in the conveying passage and moving it in a substantially horizontal plane, wherein the image bearing member, the latent image forming station, the conveying passage and the first moving mechanism are provided in a main body of the image forming apparatus, a device for accommodating a plurality of developing devices. The accommodating device is mounted to the main body, the accommodating device includes, a second moving mechanism for moving the developing device opposed to the conveying passage into the conveying passage in a substantially horizontal plane and an accommodating case having partition stages arranged substantially vertically for accommodating plural developing devices and movable together with the developing devices accommodated therein, and a driver for transmitting a driving force selectively to the first driving mechanism, the second driving mechanism and the accommodating case.

37 Claims, 30 Drawing Sheets

DEVELOPING DEVICE ACCOMMODATING APPARATUS AND IMAGE FORMING APPARATUS AND DEVELOPING DEVICE

This application is a continuation of application Ser. No. 217,078, filed July 8, 1988, which is a continuation of application Ser. No. 111,761, filed Oct. 23, 1987, both now abandoned.

FIELD OF THE INVENTION AND RELATED ART

The present invention relates to an apparatus for accommodating plural devices for an image forming apparatus such as copying machine, recording machine and printer and to an image forming apparatus and a developing apparatus usable therewith, more particularly to such apparatuses wherein the developing device is detachably mountable into the image forming apparatus.

Conventionally, a developing apparatus is set in place in an image forming apparatus such as a copying machine by an expert service operator, and thereafter, the user operator does not take the developing device out of the copying machine. Therefore, it has been necessary for that a service man to manually insert the developing device into the assembly to a position, for example, a position where the developing device is near a photosensitive member but is not contacted to the photosensitive member, and then, a manual lever is operated to urge the developing device to the photosensitive drum to correctly position it with respect to the photosensitive member. This type is disclosed in U.S. Pat. Nos. 4,373,468 and 4,583,832, for example.

Recently, however, a new type of image forming apparatus is being widely used wherein the developing device is replaceable with another developing device containing a different color toner such as red and blue in addition to black so as to permit image formation with a different color. With this trend, it is more frequent that the user operator himself mount the developing device into the apparatus or demounting it therefrom. This type is disclosed, for example, in U.S. Pat. Nos. 4,470,689, 4,500,195 and 4,575,221 wherein a process unit containing a photosensitive member and developing means is replaced; and U.S. Ser. No. 802,537 filed on Nov. 27, 1985 and assigned to the assignee of this application, wherein the apparatus contains two developing devices selectively usable, and wherein one of the developing devices is made exchangeable.

There is another proposal, as disclosed in U.S. Ser. No. 844,718 filed on Mar. 27, 1986 and assigned to the assignee of the present application, wherein two developing devices are made selectively operable. Another proposal has been made in U.S. Pat. Nos. 4,615,612 and 4,622,916 wherein the apparatus has a turret type developer accommodating means.

However, since all of the above described systems involve manual exchange or replacement of the developing device, it requires cumbersome work and involves the possibility of the developing device hitting the apparatus or the like, thus imparting unnecessary shock or vibration to the developing device.

On the other hand, considering the developing operation, the size of the developer particles are reduced in order to improve the image quality, more particularly the sharpness, with the result that the fluidability of the developer becomes higher when the developer is mixed with air. Therefore, it becomes essential that the developing device is handled with great care, since otherwise the developer becomes distributed in the container non-uniformly, or the developer is scattered out.

Generally, the non-uniform distribution of the developer in the container is solved by stirring the developer, and in consideration of variations in the manner of handling by various users, the stirring period is made relatively longer to cover wide variations. Therefore, the time required until a first copy is obtained is long after the developing device is exchanged, or after the developer is supplied in the type of the device wherein the developing device is demounted from the apparatus to supply the developer. Where the developing device is limited by a stopper when the developing device is mounted into the apparatus, the degree of resulting non-uniform distribution of the developer and the scattering vary depending on the speed at which the user abuts the developing device to the stopper.

More particularly, in the system wherein the mounting of the developing device is performed by the user, the mounting operation is like closing a drawer by the user, and therefore, the shock imparted to the developing device is different depending on the user's peculiarity in the force of mounting it. If it is strong, the strong shock is applied in the longitudinal direction of the developing device (in the system wherein the developing device is inserted through a front door of the apparatus in a direction of a generating line of a photosensitive drum contained therein), the developer in the container becomes non-uniformly distributed in the longitudinal direction. And, the developer having been urged to the rear side may blow out through a clearance around a cover of the developing device to scatter out. Particularly, when the developer is replenished, a toner bottle containing a supply of developer to be replenished is shaken so as to increase the fluidability of the developer in order for the developer therein to be completely removed from the developer bottom into the container of the developing device. This makes the developer easy to scatter.

When the developing device is exchanged, the developer contained in the developer container in the developing device usually has been kept stationary for a relatively long period of time, and therefore, the fluidability is not so high. However, if it becomes once non-uniformly distributed, it is required that the developer is positively and relatively strongly stirred by stirring means such as stirring rod. Therefore, the time period for pre-rotation of the photosensitive member to prepare the apparatus for image forming operation, has to be longer. This also results in the longer time period to the first copy from the start of the copying apparatus.

From the users standpoint, various positioning means or other means have to be operated when the developing device is demounted or mounted, and therefore, it is cumbersome.

As a proposal to a solution to the above problems, five of the inventors of the present application have filed U.S. patent application Ser. No. 071,316 filed on July 9, 1987. The proposal contains, as a feature, a passage in the image forming apparatus to allow the developing device to be mounted into or demounted from the apparatus. This invention is a further improvement of this proposal in that a plurality of developing devices are accommodated and are set in place without requiring cumbersome manipulation by the users.

SUMMARY OF THE INVENTION

Accordingly, it is a principal object of the present invention to provide an apparatus for accommodating plural developing devices which is small in size and by which a developing device containing a desired color developer can be easily and positively selected.

It is a further object of the present invention to provide an image forming apparatus which is usable with an apparatus for accommodating plural developing devices.

It is a further object of the present invention to provide a developing device which is suitably usable with an apparatus for accommodating plural developing device.

The inventors of this application have developed a small size apparatus for accommodating plural developing devices, and therefore, the size of the entire image forming apparatus can be reduced.

The present invention covers any combination of the features of the present invention which will be described hereinafter.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 14–17 are top, front and top views illustrating a linking member between the image forming apparatus and the developing device accommodating apparatus.

DESCRIPTION OF THE PREFERRED EMBODIMENTS

Figure 1:
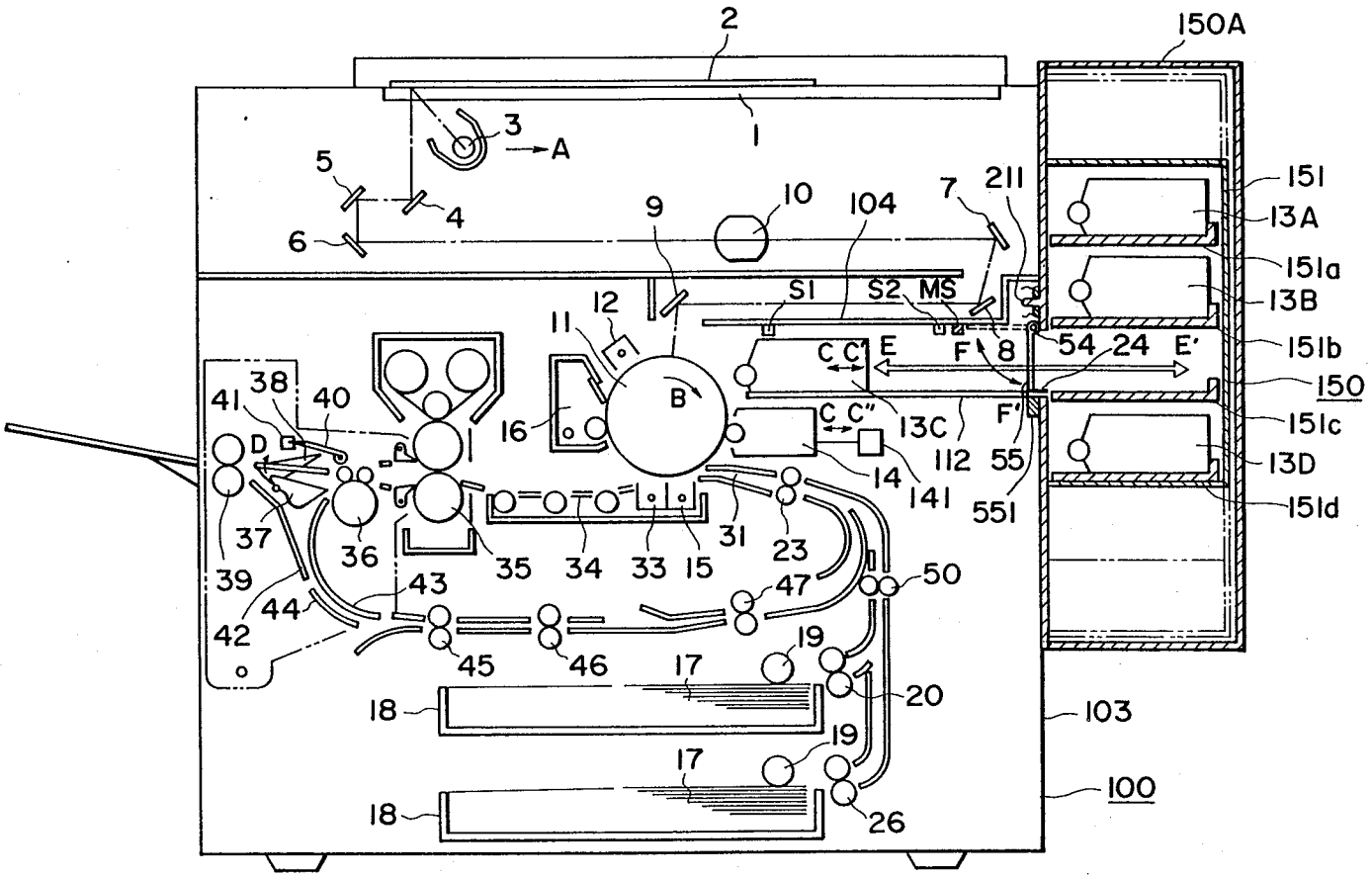
FIG. 1 is a sectional view of an image forming apparatus according to an embodiment of the present invention.

Referring to FIG. 1, there is shown an image forming apparatus, more particularly a copying machine in this example, used with an apparatus for accommodating plural developing devices according to an embodiment of the present invention. The exemplified image forming apparatus is capable of forming images on the opposite sides of a sheet in different colors and capable of forming superimposed images in different colors.

Before describing the developing device accommodating apparatus according to this embodiment, the image forming apparatus usable with the developing device accommodating apparatus will be described.

In the image forming apparatus, an original 2 placed on an original supporting platen glass 1 is illuminated by a lamp 3, and the resulting image light is introduced onto photosensitive drum (image bearing member) 11 by way of an optical system including a reflecting mirrors 4, 5, 6, 7, 8 and 9 and zoom lens 10. The lamp 3 and the mirror 4 and the mirrors 5 and 6 are moved at predetermined respective speeds in the direction indicated by an arrow A to scan the original 2. On the other hand, the photosensitive drum 11 is rotating in the direction indicated by an arrow B while being uniformly charged by a primary charger 12. When the light image is applied on the surface of the photosensitive drum 11 which has been thus electrically charged, an electrostatic latent image is formed in accordance with the original 2. Adjacent to the surface of the photosensitive drum 11, there are provided a chromatic color developing device 13C containing a chromatic color developer (green, for example) and a black developer 14 containing black developer. The developing devices 13C and 14 are movable in directions C and C', respectively to access the photosensitive drum 11 in accordance with selection of the color to develop the electrostatic latent image on the photosensitive drum 11 into a visualized image. FIG. 1 is shown as the chromatic developing device (green developing device, for example) 13C being disposed away from its operative position, while the black developing device 14 being in its operative position close to the photosensitive drum 11, so that a black image can be formed on the photosensitive drum 11. The developed image is transferred onto a sheet of paper (recording medium) by a transfer charger 15. Thereafter, the surface of the photosensitive drum 11 is conveyed to the cleaning means which is a cleaning station 16 where the remaining toner is removed from the surface of the photosensitive drum 11, so that it is prepared for the next image forming operation. The sheet 17 is fed in the following manner. There are several types of supplying means for supplying the sheet 17 to an image forming station including a photosensitive drum 11. In a first type, the sheet 17 accommodated in an upper cassette 18 is fed to the roller couple 20 by a pickup roller 19. The roller couple 20 is effective, when two or more sheets 17 are fed out, to separate the topmost sheet 17 and supply it to the image forming station. The sheet 17 having passed through the roller couple 20 is advanced to a registration roller 23 by way of guiding plates, feeding roller couple 50 and additional guiding plates. In the second type, the sheet 17 accommodated in the lower cassette 18 is fed to a roller couple 26 by a pickup roller 19, in the similar manner as described above. The registration roller 23 once stops the coming sheet 17 and starts to rotate in timed relationship with the developed image formed on the photosensitive drum 11 to align the image with the sheet. After the start of the registration roller 23 rotation, the sheet 17 is advanced to the surface of the photosensitive drum 11 by way of a top guide 31 and a bottom guide 32. The sheet 17 receives the image from the photosensitive drum 11 by the operation of a transfer charger 15. The sheet 17 is then separated from the surface of the photosensitive drum 11 by the separating charger 34 and is further advanced through the conveying passage 34 to an image fixing device 35 which contains a heating roller and a pressing roller. By the fixing device 35, the sheet 17 is heated and pressed so that the image on the sheet 17 is fixed into a permanent image. Thereafter, the sheet 17 is transported to a first discharge roller 36 and is further transported to a second discharging roller 39 by a flappers 37 and 38, by which it is discharged out of the apparatus. In this Figure, the flapper 38 is shown as closing the sheet passage, but since the flapper 38 is made of a light and soft material, and therefore, is flexible in the direction indicated by an arrow D, the flapper 38 is raised by the leading edge of the sheet 17 when it passes, so that the flapper 38 does not obstruct the passage of the sheet 17.

Next, the description will be made with respect to the flow of the sheet 17 in duplex image formation mode and superimposing image formation mode.

When the duplex image formation mode is selected in the image forming apparatus (images are to be formed on the opposite sides of the sheet 17), the sheet 17 is transported in the same manner as described above (simplex image formation mode) so that an image of the original is transferred and fixed on one side (the first side) of the sheet. The sheet is transported to the second discharging roller 39 and is further advanced thereby to an unshown tray. During this transportation, the trailing edge of the sheet 17 is detected by a sheet detecting mechanism comprising a detecting lever 40 and a photosensor 41, and after a predetermined time elapses (i.e. the time period until the trailing edge of the sheet 17 passes under the flapper 38), the second discharging roller 39 starts to reversely rotate so as to reinsert it into the apparatus. The sheet 17 is transported back with the then trailing edge leading, along the flapper 38, a left side inclined surface of the flapper 37 and the guiding plate 42. Further, it is transported by way of the guiding plate 43 and 44 and is advanced to the roller 45 with its facing orientation reversed. The sheet 17 is further advanced to a lateral registration roller 47 through a roller 46. At this time, the lateral registration roller 47 is at rest, so that the leading edge of the sheet 17 abuts the nip of the rollers 47, and thereafter, the roller couples 45 and 46 stop. When an image forming signal for the second side is produced, the lateral registration roller 47 starts to rotate so as to supply the sheet 17 along guiding plates. Prior to the sheet 17 reaching the registration roller 23, a lateral edge of the transfer sheet 17 is detected by a photosensor, and the lateral registration roller 47 corrects the lateral position of the sheet 17 in the direction perpendicular to the movement direction of the sheet 17, that is, perpendicular to the sheet of drawing, so as to align the lateral edge with the lateral edge position at the first image formation. The operations after the sheet 17 reaches the registration roller 23 are similar to the simplex image forming operations as described above. After an image is formed on the second side of the sheet 17, the sheet is discharged to the outside tray by the second discharging roller 39.

When a superimposing image formation mode is selected in the image forming apparatus, the first image formation operation is the same as the image formation in the simplex mode described hereinbefore. After the image formation on the first side, the flapper 37 is placed at a position indicated by broken lines, and therefore, the sheet 17 is discharged by the first discharging roller 36 and is transported to the guides 42 and 43 along the right side inclined surface of the flapper 37. Further, it is conveyed to the roller 45 along the guides 43 and 44. Then, the sheet 17 reaches the lateral registration roller 47 by a roller 46. When a predetermined period of time elapses after the trailing edge of the sheet 17 is detected by the detecting lever 40 and the photosensor 41, the flapper 37 is reset to the solid line position. When the second image formation signal is produced, the lateral registration roller 47 starts to rotate. The lateral shifting of the sheet 17 is the same as the case of the second side image formation in the duplex image forming operation. After the second image is formed on the transfer sheet 17, it is discharged to the tray outside of the machine by the second discharging roller 39. The foregoing explanation refers to the case where two images are superimposed, but a greater number of images may be superimposed, in which the movements of the sheet are basically the same. Here, however, the resetting of the flapper 37 from the broken line position to the solid line line position is performed only prior to the final image formation.

Now, description will be made as to the apparatus 150 for accommodating plural developing devices according to an embodiment of the present invention. The developing device accommodating apparatus 150 is optionally attached to an outside of the image forming apparatus 100, in this embodiment.

The accommodating apparatus 150 can be optionally be attached to an outside of the image forming apparatus 100 when a chromatic color image formation is desired using a chromatic color developing device other than black developing device which is fixed in the apparatus 100 in this embodiment. Then, a desired color developing device is conveyed and supplied to the neighborhood of the photosensitive drum 11 in the image forming apparatus 100.

Figure 2:
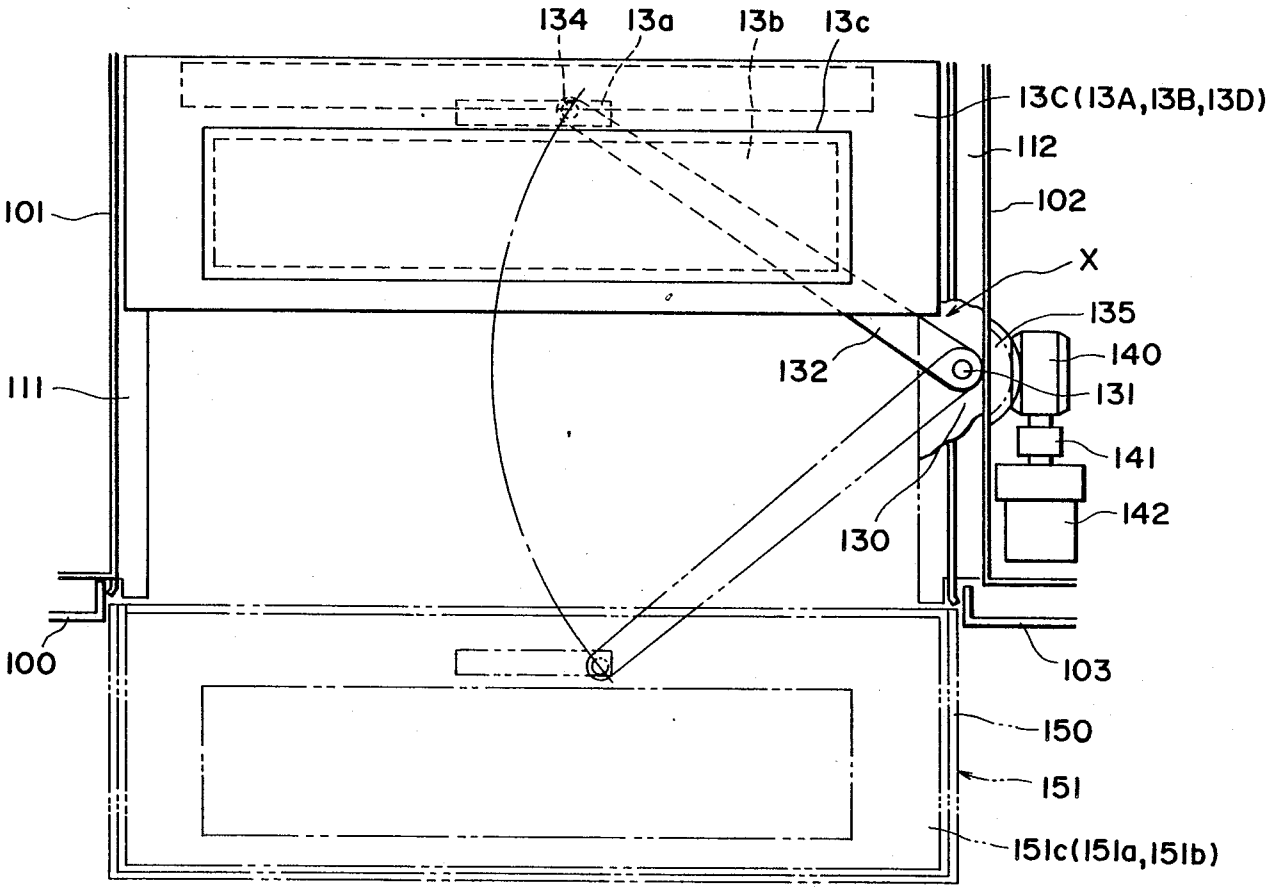
FIG. 2 is a partial top plan view of the image forming apparatus illustrating a developer moving means.
Figure 3:
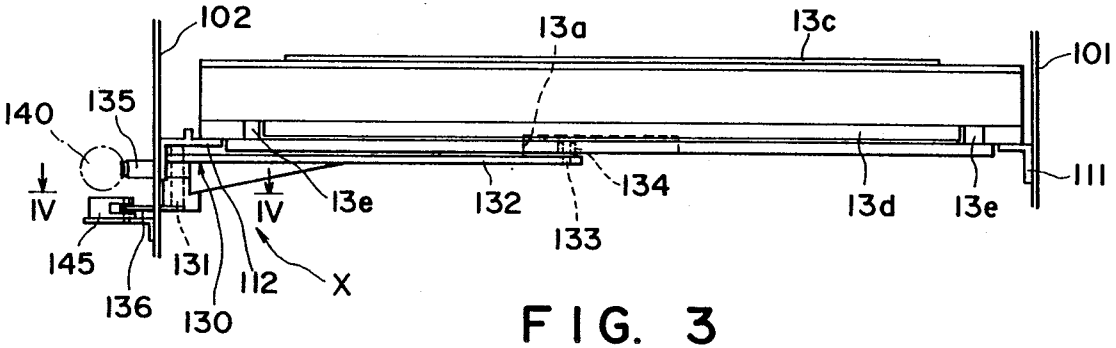
FIG. 3 is a side view of the developer moving means.
Figure 4:
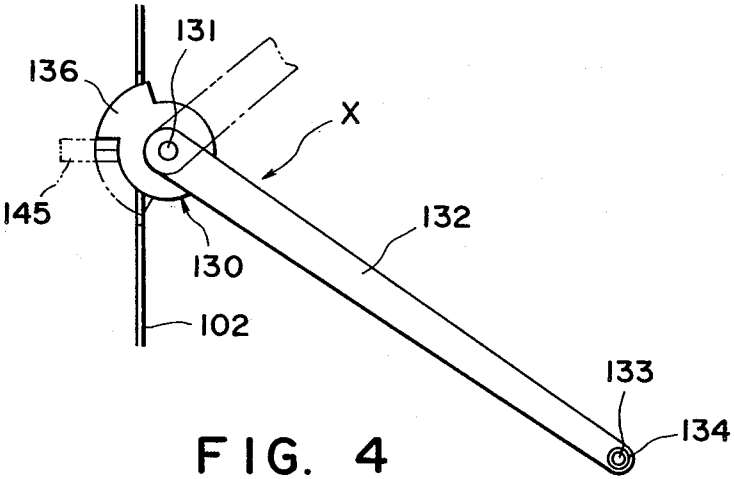
FIG. 4 is a sectional view taken along a line IV—IV.

The accommodating apparatus 150 includes as a main body an accommodating case 151 provided with partition bottom walls or stages 151*a*, 151*b*, 151*c* and 151*d* which are formed integral with the case 151. On the partition stages 151*a*, 151*b*, 151*c* and 151*d*, chromatic color developing devices containing different color toners, for example, a red developing device 13A containing a red developer, a blue developing device 13B containing a blue developer, a green developing device 13C containing a green developer and a brown developing device 13D containing a brown developer are placed and are movable away from the stages toward the image forming apparatus 100. In the example of state shown in FIG. 1, the green developing device 13C is not contained in the accommodating case 151, but is in the apparatus 100 adjacent to the photosensitive drum 11, which is ready for developing the latent image. The transportation or transfer of the chromatic color developing device (green developing device 13C) is performed by a developer transporting means X (means rotating in the direction of arrows E and E' in FIGS. 2–4). The developing device is transported into the apparatus 100 through an openable shutter (inlet) provided in the image forming apparatus 100. The shutter 55 is rotatable about a shutter shaft 54 in the directions F and F', and when the color developer is transported into the apparatus 100, the shutter is retracted to the broken line position by an unshown solenoid or the like so as not to obstruct the transportation of the developing device.

Figure 5:
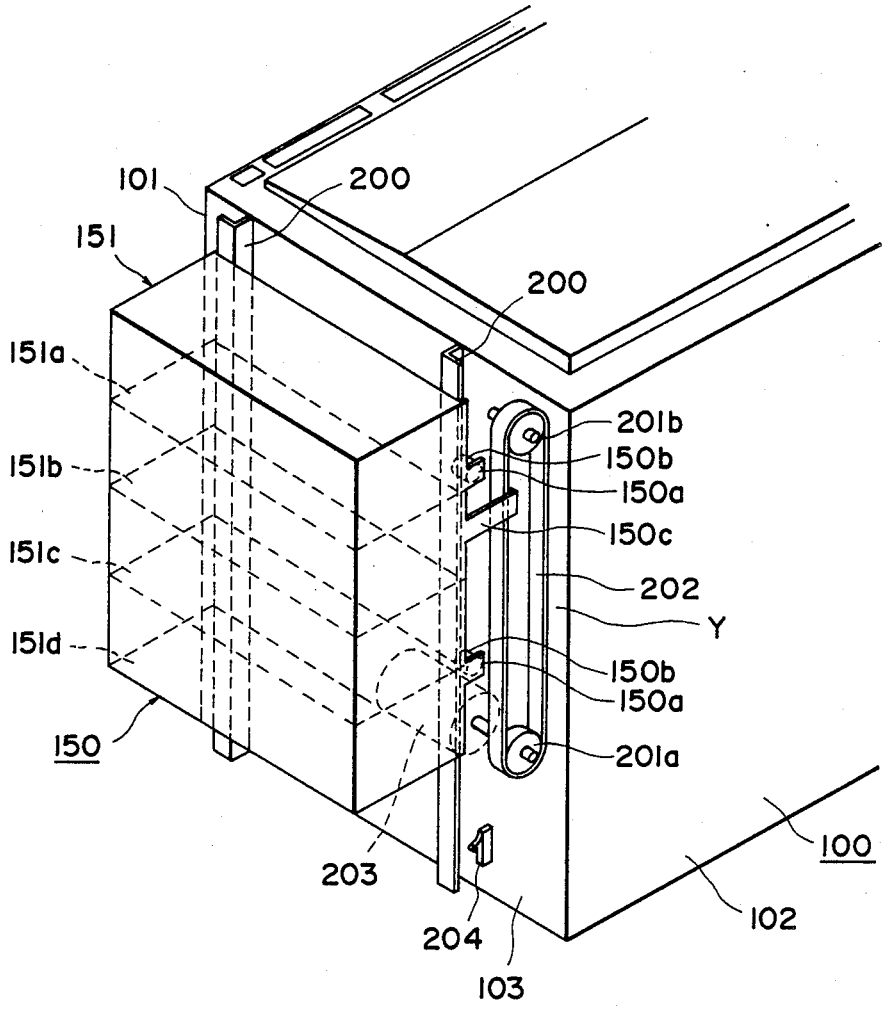
FIG. 5 is a perspective view of the image forming apparatus seen from the developer accommodating device side.

The accommodating apparatus 150 is further provided with means Y for moving the case (FIG. 5 which will be described hereinafter). By the case moving means Y, the accommodating case 151 as a whole is movable up and down relative to the apparatus 100. Therefore, one of the partition stages 151*a*–151*d* which accommodates the developing device containing the desired color is moved by the case moving means Y into alignment with the inlet of the image forming apparatus 100 constituted by the above described shutter 55 (in the example of the Figure, the partition stage 151*c* is in alignment). Thus, a desired developing device can be transported into the apparatus 100. For example, when the image forming apparatus selects the red developing device 13A, for example, the green developing device 13C then placed in the apparatus 100 is first transported back onto the partition stage 151*c* of the accommodating case 151 by the developing device moving means X. During this back transportation, the shutter 55 is retracted to the broken line position i.e., the open position. When the green developing device 13C is accommodated back into the accommodating case 151, a discriminating means Z which will be described hereinafter in conjunction with FIG. 6 confirms the presence of the green developing device 13C in the case 151. When it is confirmed, the case moving means starts to shift the entire case 151 vertically relative to the apparatus 100 (in this case, downwardly) by the case moving means Y, and stops when the partition stage 151*a* supporting the desired red developing device 13A is brought into alignment with the inlet (shutter 55) of the apparatus 100. Then, the red developing device 13A is transported to the neighborhood of the photosensitive drum 11 by the developing device moving means X shown in FIGS. 2–4, and therefore, it is placed readily for developing the latent image. The operation is the same when another color developing device in the accommodating case 151 is selected.

Front and rear plates 101 and 102 of the image forming apparatus 100 have slide guides 111 and 112 fixed to the inner sides thereof to support and guide the color developing device from the accommodating case 151 to the photosensitive drum 11. The shutter shaft of the shutter 55 constituting the inlet of the apparatus 100 is fixed to the front and rear plates 101 and 102 at its opposite ends. When the shutter takes the closing position as indicated by solid lines in FIG. 1, the shutter is attracted to a magnet catch 551 provided on the apparatus 100 to maintain the closed state. On the other hand, when it takes the open position indicated by broken lines, an end of the shutter 55 is abutted to a stay 104 of the apparatus 100 to maintain the open state. At this time, the shutter is attracted by an unshown solenoid or the like, as described hereinbefore. Adjacent a position where the shutter 55 abuts the stay 104, a microswitch MS is provided to detect the shutter 55 taking the open position.

A groove 13*a* is formed by ribs on an outside surface of the bottom wall of each of the chromatic color developing devices 13A, 13B, 13C and 13D to engage a pressing roller of a driving arm which will be described hereinafter. The top wall of each of the developing devices is provided with an opening 13*b* for supplying the developer, which is covered by a cover 13*c*. Further, opposite end flanges of a developing sleeve 13*d* are provided with rotatable abutting rollers 13*e* for maintaining a predetermined clearance between the developing sleeve 13*d* surface and the photosensitive drum 11 surface.

Below one of slide guides 112, there is provided a driving arm 130 having a driving area to transport a selected color developing device from the accommodating case 151 to the neighborhood of the photosensitive drum 11 of the apparatus 100. The driving arm 130 is rotatable about a shaft 131 mounted perpendicularly to the slide guide 112. On the other hand, a long arm 132 is mounted to the color developer side and is provided at its one end with a thin 133 supporting a pressing roller 134 engageable with the slot 13*a* of the color developing device. To the other end of the arm 132, a worm wheel gear (sector gear) 135 is mounted. The worm wheel gear has a central shaft 131 and is projected out of a rear plate 102 through an opening provided therein. The worm wheel gear 135 is meshed with a worm gear 140 provided on the image forming apparatus 100 outside the rear plate 102. The worm gear 140 is operatively connected to a motor (DC motor) 142 reversely rotatable through a torque limiter 141. Further, outside the rear plate 102, there is provided a photointerruptor 145 to detect the amount of rotation of the arm 132. The photointerruptor 145 is effective to detect the current position of the arm 132 by detecting a slot or slots of a disk 136 formed as a part of the driving arm 130.

The operation of the driving arm 130 will be described. When instructions to change the color, for example, from the green developing device 13C to the red developing device 13A, in the image forming apparatus, is produced, the motor 142 is released from the locking, whereby the twisting of the torque limiter 141 spring-charged is eased, so that the pressure by which the green developing device 13C is pressed toward the photosensitive drum 11 is released. Then, the motor 142 starts to rotate in the backward rotation so that the pressing roller 134 at the end of the arm 132 pushes the wall of the groove 13*a* on the bottom of the green developing device 13C so as to move the green developing device 130 in the direction E'. During this operation, the arm 132 swings. When the end thereof reaches the neighborhood of the shutter 55 then opened, the photointerruptor 145 detects the slot of the disk 136. A predetermined period of time thereafter, the motor 142 stops. By those operations, the green developing device 13C is accommodated back into the partition stage 151*c* of the accommodating case 151. When it is accommodated back, the discriminating means Z shown in FIG. 6 confirms the existence of the green developing device 13C. Thereafter, the accommodating case 151 is moved vertically, more particularly, downwardly, by the case moving means Y (FIG. 5). When partition stage 151*a* accommodating the red developing device 13A which is the desired developing device is brought into alignment with the inlet of the apparatus 100, it stops. Subsequently, the motor 142 starts to rotate in the forward direction, by which the arm 132 swings, so as to move the red developing device 13A in the direction E through the pressing roller 134. It is transported into the apparatus 100 through the shutter 55. The arm 132 rotates further, and when the pressing roller 134 reaches that edge of the movable range which is near the photosensitive drum, the slot of the disk 136 actuates the photointerruptor 145 to inform a control means of the image forming apparatus of the completion of the transportation of the red developing device 13A. For a predetermined period thereafter, the motor 142 continues to rotate, by which a spring of the torque limiter 141 is charged, and a pressure is urged to the pressing roller 134 at an end of the arm 132. Therefore, the red developing device 13A is contacted to the photosensitive drum 11 through spacer rollers 13*e* mounted coaxially with the developing sleeve 13*d* to maintain a space between the developing sleeve 13*d* and the photosensitive drum 11.

Description will be made with respect to the case moving means by shown in FIG. 5. A couple of rails 200 are mounted to the rear plate 103 of the apparatus 100 and are extended substantially vertically and in parallel with each other. With the rails 200, the accommodating case 151 is engaged for vertical movement. The accommodating case 151 is engaged with the rails 200 through guides 150*a* formed at the upper and lower positions thereof. The guide 150*a* is provided with roller 150*b* to reduce the friction, and the roller 150*b* rolls on the inside surface of the rail 200. To the side plate 103, there are rotatably mounted a driving pulley 201*a* and a follower pulley 201*b* which constitute moving means. A belt 202 is trained around the pulleys 201*a* and 201*b* with a predetermined tension. To a part of the belt 202, an arm 150*c* integral with the accommodating case 151 is connected. A central shaft of the bottom pulley which is a driving pulley 201*a* is connected to a reversible motor (pulse motor) 203, so that the accommodating case 151 moves substantially vertically relative to the apparatus 100 along the rails 200 by the rotation of the motor 203. A microswitch 204 is mounted to the accommodating case 151, and is actuated by a part of the accommodating case 151 when the red developing device 13A accommodated on the top stage of the accommodating case 151 is positioned in alignment with the inlet of the apparatus 101. The operation timing of the accommodating case moving means Y has been described together with the operation of the developing device moving means X, and therefore, the description thereof is omitted for the sake of simplicity, with the exception of the following. The motor 203 starts to rotate in response to the instructions from the control means of the image forming apparatus 100 and stops after rotating through a predetermined amount in a predetermined direction. The direction and the amount are set depending on how far the color developing device is currently placed from the inlet of the apparatus.

In this embodiment, the moving mechanism essentially consists of a driving pulley 201*a*, a follower pulley 201*b* and a belt 202. However, other types are usable, for example, a rack-pinion mechanism or linear motor mechanism may be usable.

The accommodating case moving means Y also functions in the case that the pressing roller 134 of the arm 132 is released from the groove 13*a* of the color developing device when the developing device accommodated in the apparatus 100 is returned into the accommodating case 151 by the driving arm 130 in response to developer changing instructions. At the time when the color developing device is returned onto the partition stage of the accommodating case 151, the pressing roller 134 of the arm 132 is in engagement with the groove 13*a* of the color developing device, so that the arm 132 is in the position where it can not be retracted to the position not interfering with the vertical movement of the accommodating case 151. Therefore, in order to release the pressing roller 134 from the groove 13*a* for the purpose of enabling the arm 132 to retract, the accommodating case moving means Y drives the case 151 slightly when it is confirmed by the discriminating means Z that the color developing device is returned into the accommodating case 151. More particularly, the motor 203 rotates through a small amount to lift the accommodating case 151 through an amount corresponding to the width of the pressing roller 134. By doing so, the arm 132 is now able to retract to a position not interfering with the vertical movement of the accommodating case 151. Only then, the moving means Y performs predetermined operations to move the accommodating case 151.

In this embodiment, the accommodating case moving means Y raises the accommodating case 151 to release engagement between the pressing roller 134 of the arm 132 and the groove 13*a* of the color developing device side. Alternatively, however, a rib constituting the groove 13*a* is made pivotable so that when the color developing device is accommodated back into the accommodating case 151, the rib is pivoted to release the engagement between the pressing roller 134 and the groove 13*a*, by which the arm 132 can be retracted to the position not obstructing the vertical movement of the accommodating case 151.

Figure 6:
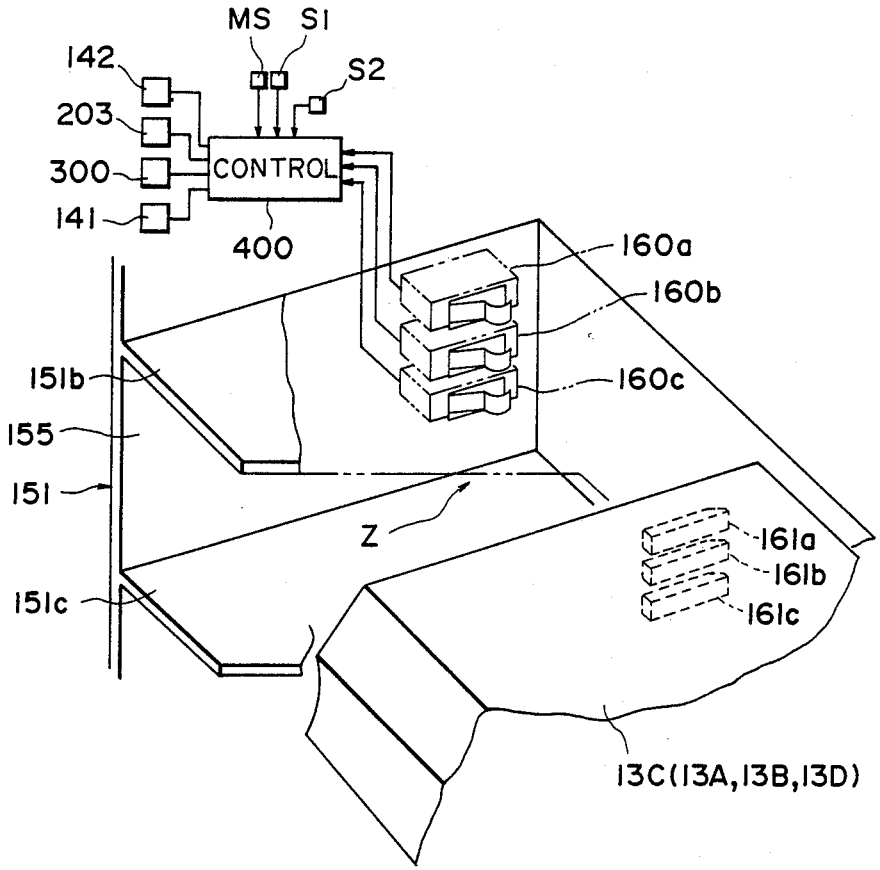
FIG. 6 is an enlarged perspective view of FIG. 5.

Referring to FIG. 6, description will be made as to the discriminating means Z for discriminating a color of the developer contained in a particular color developing device when it is returned onto a predetermined partition stage of the accommodating means 151 by the developing device moving means X from the apparatus 100.

The discriminating means Z comprises color detecting switches (microswitch) mounted in the accommodating case 151 and a color detection projection provided in the color developing device. A rear wall 155 of the accommodating case 151 is provided with three color detecting switches 160*a*, 160*b* and 160*c* which are juxtaposed for each of the developing device accommodating portions constituted by the partition stages 151*a*–151*d*, respectively. Correspondingly, the rear wall of each of the color developing devices 13A, 13B, 13C and 13D is provided with three color detection projections 161*a*, 161*b* and 161*c* which are juxtaposed to actuate the color detection switches 160*a*, 160*b* and 160*c*, respectively. Therefore, when the color developing devices 13A, 13B, 13C and 13D are inserted sufficiently to a predetermined position in the developing device accommodating portions, the color detection projections 161a, 161b and 161c actuate color detecting switches 160a, 160b and 160c. In response to the signals from the detecting switches, the color of the developer contained in the color developing device is discriminated, simultaneously with the detection of presence or absence of the color developing device in the respective developing device accommodating portions.

In this example, the color and the presence-or-absence detections are carried out in this manner. The signals from the color detection switches 160a, 160b and 160c are represented by switches S1, S2 and S3, respectively, which signals are 0 when opened, and 1 when closed. The absence of the color developing device is detected by all the signals S1, S2 and S3 being 0. When S1=1, S2=0, S3=0, then it is discriminated that the developing device for red for example. Further, when S1=1, S2=1 and S3=1, for example blue is discriminated, for example. Here, it is a matter of course that the color detection projections 161a, 161b and 161c are constructed so as to the above formula.

In this example, the color and the presence-or-absence of the color developing device are detected by cooperation between the three microswitches for color detection 160a, 160b and 160c provided in the developer accommodating portions of the accommodating case 151 and the three color detection projections 161a, 161b and 161c provided in the color developing devices 13A, 13B, 13C and 13D. However, the number of those switches are not limited to this example, but may be suitably selected by one ordinary skilled in the art. Further alternatively, the color detection switches may be of a photointerruptor type or the like in place of the microswitch type. What is required here is that the color discrimination and the presence-or-absence discrimination can be performed when the color developing device is accommodated in place in the developing device accommodating portions.

In this example, whether a color developing device is accommodated in place or not in the associated developing device accommodating portion is discriminated utilizing the color discriminating means. However, another type of discriminating device may be employed by one skilled in the art.

The developing device accommodating apparatus according to this embodiment is thus provided with the developing device detecting means for the respective developing device accommodating portions, and therefore, the following advantages are provided:

(1) The developing device accommodating apparatus is kept informed of which (color) developing devices are accommodated in which accommodating portions, and therefore, it is not necessary to input this information during an initializing stage of the operation. Furthermore, even if a temporary power shut down takes place, an undesired developing device is not selected, which otherwise may occur due to breakdown of the memory.

(2) It is possible to display which (color) developing devices are accommodated currently in which accommodating portions of the developing device accommodating apparatus, on the display of the image forming apparatus using the control system of the image forming apparatus. Also, it is easy to provide means for displaying which developing device is selectable from the accommodating apparatus, independently of the control system of the image forming apparatus.

(3) When a developing device is taken out, any care is not required as to the accommodating portions when it is reinserted.

(4) The signal produced by the developing device detecting means is taken as a signal representing that the developing device is completely returned, so that, for example, the signal is utilized for the next sequential operation control, for example, in response to this signal, the developing device moving means and the case moving means are controlled on the basis of this signal.

The number of developing devices accommodatable in the accommodating case 151 is determined, depending on the space in which the accommodating case 151 can occupy and which is outside the apparatus 100. Any number of developing devices can be placed as long as the space accommodates.

The developing device contained in the accommodating case 151 is not limited to the one containing the chromatic colors as explained in the foregoing, but may be an auxiliary developer containing the black toner. Also, the developing devices accommodatable in the case 151 do not necessarily contain different color developers, on the contrary, plural number of developing devices for the same color may be contained, if for example, the color is frequently used. When the auxiliary black developing device is contained or plural developing devices containing frequently used color developer, the developer (toner) may be supplied to the empty one without stopping the image forming operation. Therefore, the necessity has been eliminated for the interruption of the image forming operation which is required conventionally when the developing device becomes empty or short of the developer. In addition, the toner scattering during the toner replenishing operation can be avoided, so that the image deterioration which otherwise is caused by contaminating the guiding plate or the like in the sheet conveying passage can be eliminated.

In this embodiment, the plural developing device accommodating apparatus is an option, so that the image forming apparatus is operable without the accommodating apparatus. In this case, the usual monochromatic image forming operation is performed using the black developing device 14 equipped in the apparatus 100.

Figure 7:
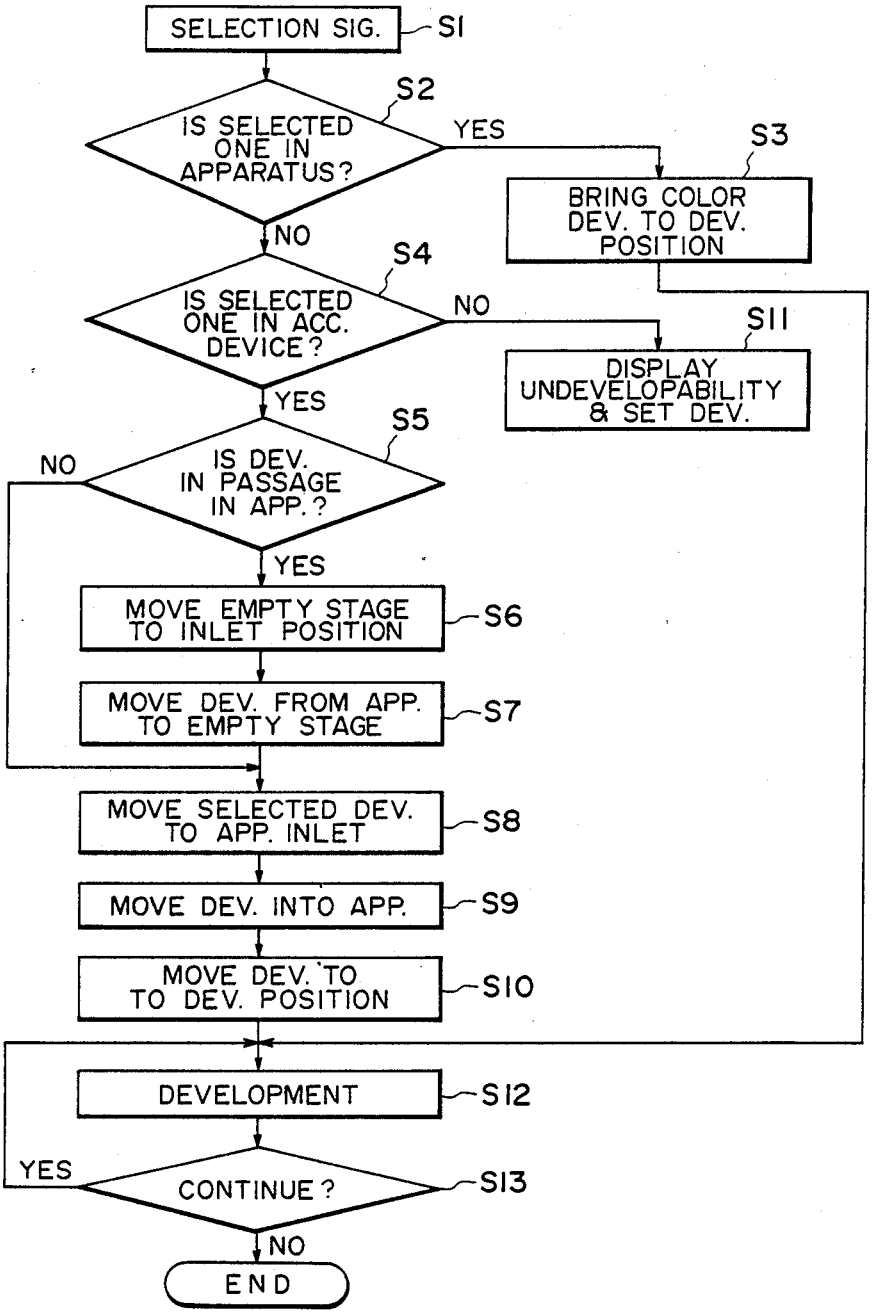
FIG. 7 is a flow chart illustrating a part of operations in the apparatus shown in FIG. 1.

Referring to FIG. 7, the color developing device supplying operations will be explained, which are performed under the control of the control means 400 of the image forming apparatus.

When a selection signal is inputted into the control means (step 1), discrimination is first made as to whether or not the selected color developing device is set in the apparatus 100 from the information provided by the discriminating means Z (step 2). When it is confirmed that the selected developing device is set in the apparatus 100 (yes), the sequence goes to step 3 where the color developing device is shifted to the operative position by the above-described developing device means means X. If, on the other hand, it is discriminated that the selected color developing device is not in the apparatus 100 (no) by the sensors S1 and S2, the sequence goes to a step 4, where discrimination is made further as to whether or not the selected color developing device is in the developing device accommodating apparatus 150 from the information provided by the color discriminating means Z. When it is confirmed by the sensors S1 an S2 that the selected color developing device is in the developing device accommodating apparatus 150 (yes), the sequence goes to a step 5 where discrimination is made as to whether a color developing device is in the transportation passage in the apparatus 100 or not. If so, the sequence goes to a step 6 where an empty stage of the accommodating apparatus 150 is brought into alignment with the shutter 55 (inlet to the apparatus 100) by the case moving means Y, and then at step 7, the color developing device in the transportation passage of the apparatus 100 is accommodated back into the empty stage by the developing device moving means X. Subsequently, at step 8, the selected developing device in the accommodating apparatus 150 is moved to the supply level by the case moving means Y. At step 9, the selected color developing device is supplied into the apparatus 100 from the accommodating apparatus 150. When the switch S1 detects that the selected developing device is now at the developing-stand-by position, the supplied color developing device is moved to the operative position at step 10. Here, at steps 9 and 10, the developing device moving means X operates. On the other hand, if at the step 4, it is discriminated that the selected color developing device is not contained in the accommodating apparatus 150 (no), the sequence goes to step 11 to display incapability of development and necessity of setting the developing device into the accommodating apparatus 150. If at step 5 it is discriminated that there is no color developing device in the passage of the apparatus 100, the sequence goes to step 8 where the selected color developing device in the accommodating apparatus 150 is moved to the supplying inlet.

Upon completion of execution at steps 3 and 10, the developing operation is performed at step 12; and at step 13, the necessity of continuing the operation is discriminated. If the necessity exists, (yes), the feedback control is executed, while if not (no), this routine ends.

The control means 400 is provided with an interface for transmitting a signal from the main apparatus 100 to the developing device accommodating apparatus 150 and for transmitting a signal from the accommodating apparatus 150 to the main apparatus.

As described in the foregoing, according to this embodiment, a developing device selected in accordance with a selection signal is automatically sent out of the developing device accommodating portion, and the developing device is automatically transported into the apparatus to place the image forming apparatus under the condition of performing the desired image forming operation, whereby the setting of the required developing device can be executed without resort to manipulation by the operator and with precision and high speed. In addition, it can be avoided for the apparatus to become bulky by being equipped with plural developing devices.

Figure 8:
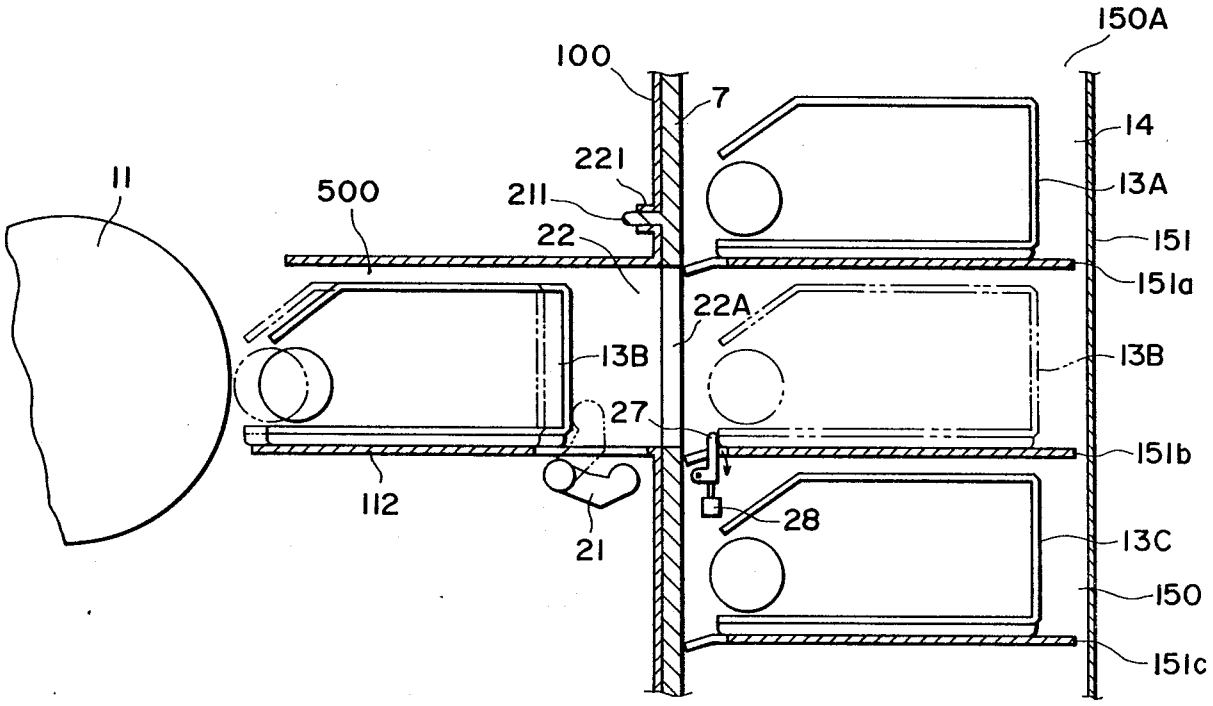
FIG. 8 is a sectional view illustrating junction between the image forming apparatus and the developing device accommodating apparatus.

FIG. 8 illustrates a connecting portion between the apparatus 100 and the accommodating apparatus 150. In the main body of the image forming apparatus, there is formed a developing device transportation passage 500 by slide guides 112 to connect the development operative position in the neighborhood of the photosensitive drum 11 and the developing device inlet 22 closed or opened by the shutter 55.

The developing device accommodating apparatus 150 comprises a base member 7 in the form of a flat plate provided with a developer supplying inlet 22A at predetermined inlet positions and an accommodating case 151 substantially vertically movable by an unshown driving mechanism relative to the base member 7. The front end (left side in this Figure) of the accommodating case 151 is opened, and the base member functions also as a cover for the case 151.

Figure 9:
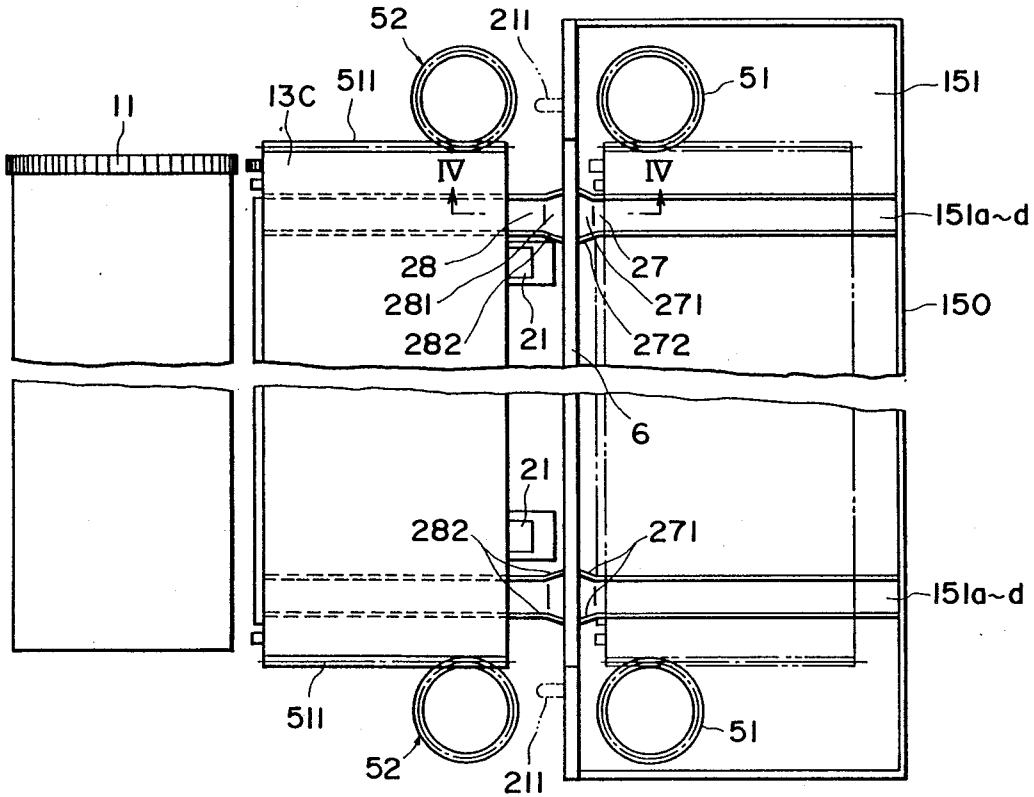
FIG. 9 is a top plan view illustrating another example other than FIG. 8 example.

As shown in FIGS. 8 and 9, pins (engaging means) 211 and 211 are fixedly mounted to the base member 7 of the accommodating apparatus 150 at front and rear sides of the supplying inlet 22A to correctly position the developing device supplying inlet 6 relative to the developing device inlet 22 in the vertical and horizontal directions. The pins 211 and 211 have tapered ends.

When the developing device accommodating apparatus 150 is to be mounted to the main body 100 of the image forming apparatus, the apparatus 150 is so positioned so that horizontal pins 211 are aligned with horizontal holes formed at both sides of the developing device inlet 22 in association with the pins 211, and then the apparatus 150 is moved so that the pins are engaged into the holes. Thereafter, the base member 7 is fixed to the main body 100 by disengageable fixing means such as both or the like.

In this manner, the supply port 22*a* of the developing device accommodating apparatus 150 is positioned with respect to the developing device inlet 22 of the apparatus 100 with high precision. Therefore, a selected color developing device selected in the accommodating apparatus 150, i.e. the green developing device 13D in the illustrated example can be smoothly transported to the supply port 22*a*, and it is further smoothly transported from the inlet 22 to the operative position by the transporting means in the apparatus 100 (lack 511 and pinion 52), so that the desired developing device can be delivered to the operative position without problem. The pins 211 and holes 221 may be interchanged.

Figure 10:
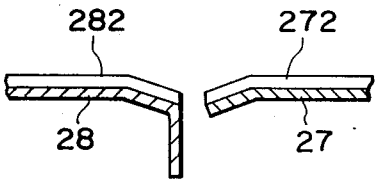
FIG. 10 is a sectional view further illustrating a major part of FIG. 9 arrangement.
Figure 21:
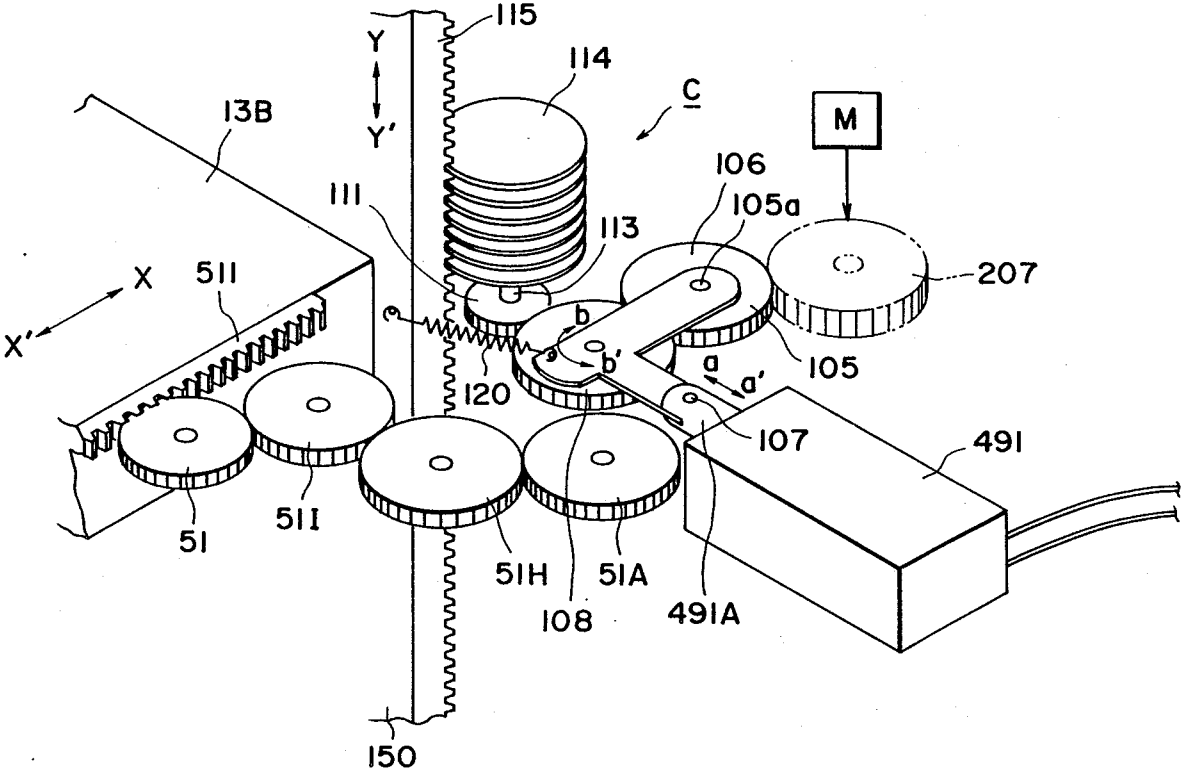

Referring to FIGS. 9 and 10, description will be made with respect to a structure for accommodating vertical and horizontal deviation at a transfer position between the image forming apparatus 100 and the accommodating apparatus. As shown in FIGS. 5 and 21, if there is a deviation between the slide guide 27 and 27 of the developing device accommodating portion which accommodates the selected color developing device and the slide guides 28 and 28 of the conveying passage 500 of the apparatus 100 after the accommodating case 151 is properly moved by the moving mechanism Y (a vertical deviation is shown in this Figure but the deviation may be horizontal), then the color developing device can not be moved smoothly, particularly when it is transported from the accommodating case into the apparatus 100.

To obviate this problem, the slide guides 28 of the apparatus 100 and the slide guides 27 of the accommodating case are expanded to provide a wider sliding space at the respective connecting sides. The slide guides 27 and 28 are in the form of a channel to be engaged with associated projections formed on the bottom surface of the developing device at both sides, and the lateral walls 272 and 282 and the bottom walls 281 and 271 of the channel are slanted to provide gradually expanding guide space. Therefore, even if there is a horizontal deviation and/or a vertical deviation between the slide guide 27 of the apparatus 100 and the slide guide 28 of the accommodating case 150, the color developing device is positively guided by the inclined surface so that it can be transferred to the opposite apparatus with certainty.

Figure 11:
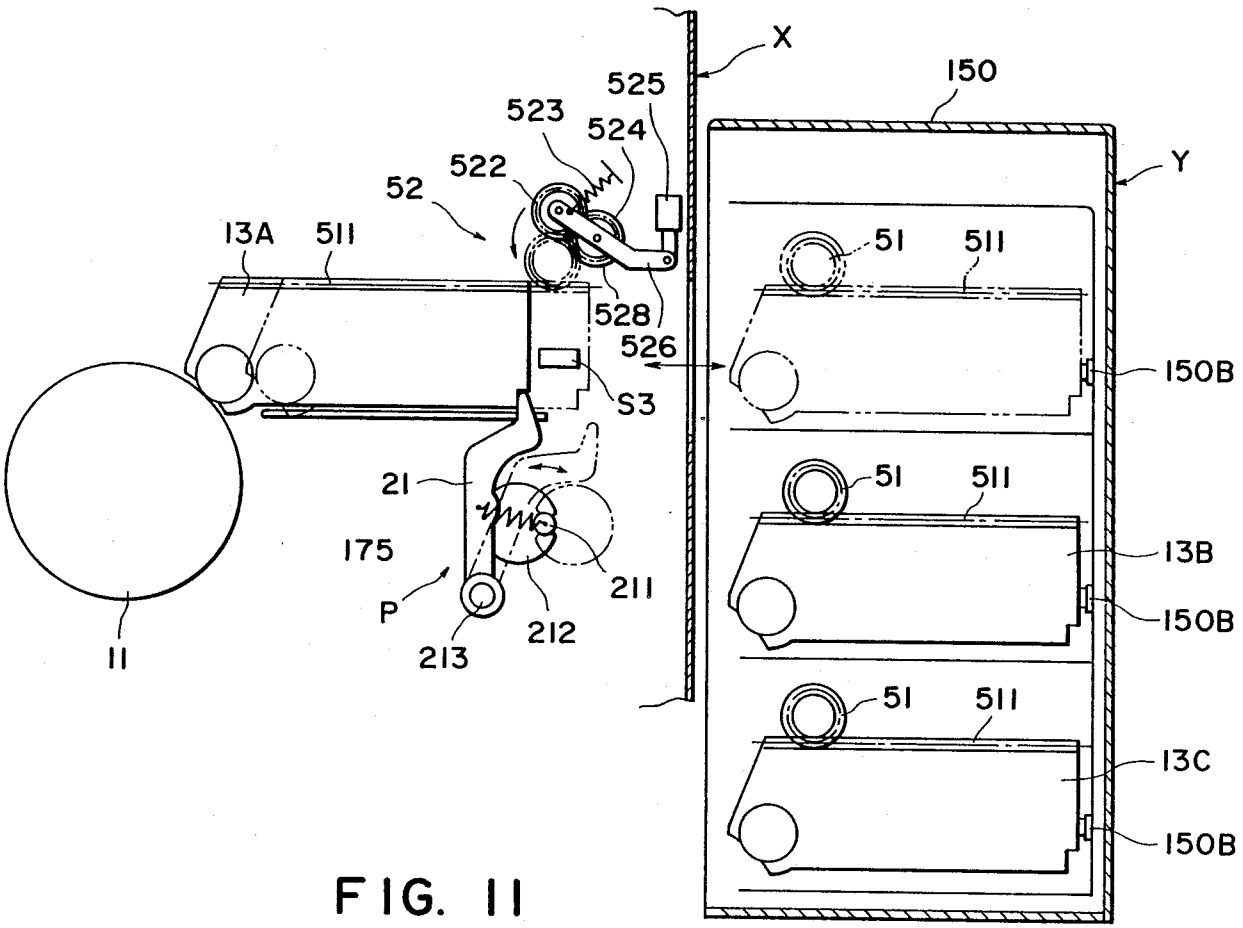
FIG. 11 is a sectional view illustrating movement of the developing device according to a first example.

Referring to FIG. 11 together with FIGS. 8 and 9, the description will be made with respect to a developing device urging means P. In FIG. 11, the solid lines show the state wherein the developing device urging means P is in the position of urging the developing device, while the phantom lines illustrate the state wherein it is released.

The urging means P is disposed below each of the slide guides 112 adjacent the operative position in the apparatus 100, and performs its urging and releasing operation in association with operations of the developing device transporting means. As will be described in detail hereinafter, the releasing operation is effected when color changing instructions are produced in the image forming apparatus, and the developing device transporting means starts operation. The urging operation is effected when it is known that the developing device has been transported into the image forming apparatus by the developing device transporting means.

The urging means P includes an urging lever 21 actable on a lower portion of the rear surface of the developing device (red developing device 13A, for example) to urge the developing device to the outer surface of the photosensitive drum 11, a cam 212 for rotating the urging lever 21 and a reset spring.

The urging lever 21 is rotatably mounted about a fixed pin 213. The cam 212 is fixed on a rotatable shaft 211. When the cam 212 rotates by rotation of the rotatable shaft 211, the urging lever 21 rotates about the fixed pin 213 while being in contact with the cam surface behind the lever 21. When the rotatable shaft 211 rotates so that the cam 212 takes the leftmost position, the urging lever 21 moves upwardly. When the rotatable shaft 211 further rotates from this state so that the cam takes the rightmost position, the urging lever 21 is moved downwardly by the function of the spring as shown in FIG. 11. The maximum rotatable range when the urging lever 21 is at the top position, is limited by a regulating pin (stopper 175 which is provided for the purpose of safety in an emergent situation). By this structure, the urging lever 21 upon urging operation, urges the developing device under predetermined pressure in the transportation passage, while upon being released, it is retracted to below the slide guide 112, that is, it is retracted from the passage 500 downwardly. Therefore, the developing device is positioned at the operative position by the urging means with certainty and with high accuracy, and further the horizontal movement of the developing device can be performed smoothly.

Figure 12:
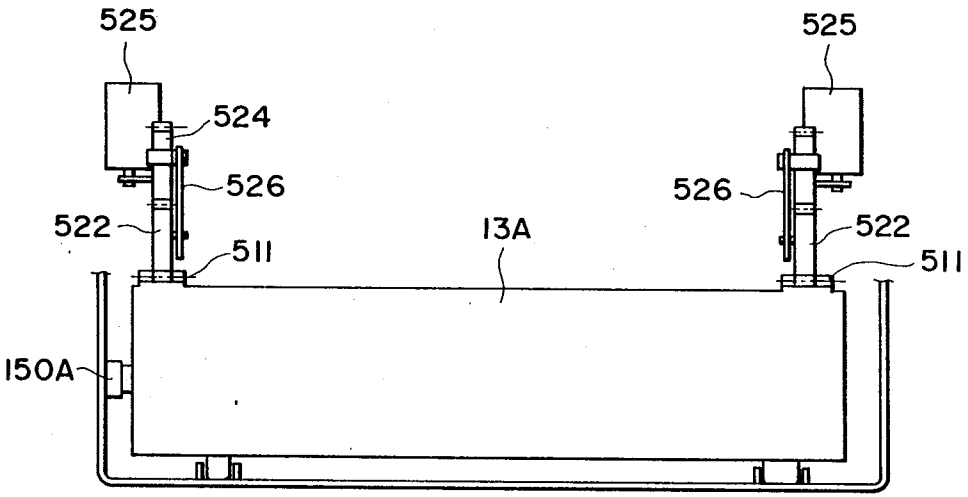
FIG. 12 is a side view of FIG. 11 arrangement.

Referring to FIGS. 11–14, description will be made with respect to the structure by which the developing device can be positioned with better precision with respect to the urging operation to the developing position and the developing device transporting means (particularly in the image forming apparatus). In FIGS. 11 and 12, the image forming apparatus includes the main body X and the developing device accommodating apparatus Y juxtaposed therewith. The accommodating apparatus Y accommodates therein on stages plural developing devices 13A, 13B and 13C containing different color toners. The accommodating apparatus Y is movable substantially vertically to face a desired developing device, for example, 13A to an inlet of the main body X, and the developing device is transported to an inoperative position (chain line position in FIG. 11) adjacent the photosensitive drum 11.

In FIG. 11, the following structure is provided at each side with respect to direction of the developing device transportation. An urging means P functions to urge the developing device 13A positioned at the inoperative position to the photosensitive drum 11 so as to be in contact therewith. The urging means P includes an urging cam 212 fixed to a driving shaft 211 rotatable by a driving source and an urging lever 21 journaled on a pin 213 and is kept in contact with the urging cam 212 by a spring. A transporting means 53 for transporting the developing device between the inoperative position and the accommodating apparatus Y will be described. An idler gear 524 is fixed to a driving shaft 528 driven by an unshown driving means, and a lever 526 is rotatably mounted to the driving shaft 528. To an end of the lever 526, a first transporting gear 522 is mounted in meshing engagement with the idler gear 524 at all times. The other end of the lever 526 is connected to an operating arm of a solenoid 525 and is always urged in the clockwise direction by a spring 523 mounted to the first transporting gear 522 side. The accommodating apparatus Y is provided with a second transportation gear 51 at each of the accommodating portions, which is meshable with a rack 511 formed on left and right portions of the top surface of each of the developing devices 13A, 13B and 13C. The driving source for the second transportation gear 51 may be common with or separate from that for the first transportation gear 522.

Now, description will be made with respect to operation for vertically moving the accommodating apparatus Y to transport a selected developing device, for example, 13A to the inoperative position. First, the second transportation gear 51 rotates to transport the developing device 13A toward the main body X by way of the rack 511. When a microswitch S3 mounted in the main body X detects the arrival of the developing device 13A, the solenoid 525 is driven to rotate the lever 526 in the counterclockwise direction. By this, the first transportation gear 522 moves to the position indicated by chain lines in FIG. 11 to be brought into meshing engagement with the rack 511 of the developing device 13A. As will be understood from the positional relations shown in the Figures, there exist a time period during which both of the gears 51 and 522 are in meshing engagement with the rack 511 of the developing device 13A, whereby the transportation is stabilized. The developing device 13A is further advanced to the inoperative position (the chain line position in FIG. 11) where it is stopped. When the stoppage is detected, the solenoid 525 deenergized, the lever 526 rotates in the clockwise direction by the function of the spring 523, so that the first transportation gear 522 is disengaged from the rack 511 to move to the solid line position. Then, the urging cam 212 of the urging means rotates to the solid line position from the chain line position to rotate the urging lever 21, by which the developing device 13A is urged by the urging lever 21 to the solid line position, that is, the development operating position, and is urged to the photosensitive drum 11 at a predetermined pressure. Thus, the developing device 13A is placed in the position capable of developing the latent image on the photosensitive drum 11.

The main body X is equipped with an additional developing device (not shown), for example, a black developing device which is always set therein adjacent the photosensitive drum. When this black developing device is to be operated, the abovedescribed red developing device 13A has to be retracted to its inoperative position. To do this, the pressing cam 212 is rotated to the chain line position, by which the urging lever 21 rotates in the clockwise direction so that the urging action to the developing device 13A is eased, and the developing device 13A is retracted to the inoperative position by a conventional moving means responsive to the easing of the urging action. When the developing device 13A is returned to the accommodating apparatus Y, the discrimination is first made as to whether or not the developing device 13A is in the inoperative position, using the microswitch S3. If this is discriminated, the solenoid 525 is driven, so that the lever 526 is rotated in the counterclockwise direction, and the first transportation gear 522 is meshed with the rack 511. Next, by the reverse rotation of the first transportation gear 522, the reverse transportation of the developing device 13A starts. When the developing device 13A reaches the accommodating apparatus Y, the back transportation is continued by the second transportation gear 51. When the microswitch 150B is actuated, the back transportation is completed, and is stopped.

In this embodiment, when the developing device 13A is in the image forming apparatus, more particularly, in the developing position, the first transportation gear 522 of the transportation means 52 is not meshed with the rack 511, but is engaged with the rack 511 when the developing device 13A is at the inoperative (stand-by) position. Due to this disengagement between the first transportation gear 522 and the rack 511, the transportation means 52 and the urging means are free from interference with each other. As a result, the developing device can be positioned in the image forming apparatus with accuracy, and it is contacted to the photosensitive drum 11 with a proper pressure.

Further, in this embodiment, the driving source for the first transportation gear 522 is not given an unnecessary load, and when the developing device 13A returns to the inoperative position, the gear 522 and the rack 511 can be meshed in good order.

Figure 13:
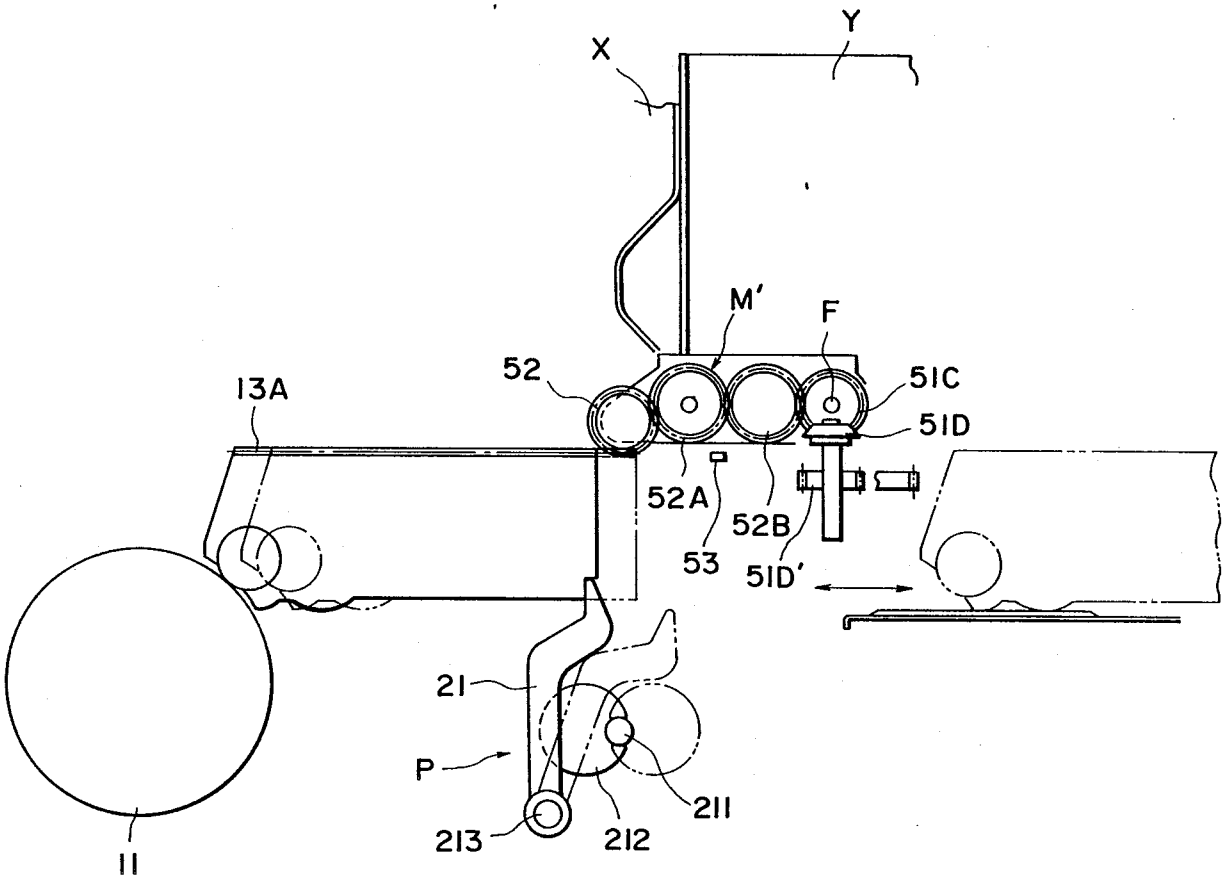
FIG. 13 is a sectional view illustrating a further preferable second example of the developing device moving mechanism.

A modification of the above described second embodiment will be described in conjunction with FIGS. 13 and 14. This modification is made to the drive transmission system for the rack and gear of the developing device and the gear of the accommodating apparatus in FIGS. 11 and 12 structure. A driving shaft F1 is operatively connected to an unshown driving source. The driving force is transmitted to a gear 51A through the driving shaft F1. The gear 51A is mounted to a plate 51F. To the plate, gears 51E and 51G are mounted at one side of the gear 51A, and gears 51H and 51C and the second transportation gear 51 are mounted at the opposite side thereof. Further, to the plate 51, an end of a link 52C connected to an unshown solenoid is connected. The plate 51F is rotatable in a horizontal plane by the solenoid. When the plate 22 is in the position indicated by solid lines in FIG. 14, the gear 51G is meshed with the gear 51D, while the second transportation gear 51 is meshed with the rack 511 formed at the side wall of the developing device 13A. The rotation of the gear 51G is transmitted to the rotational shaft F through the gears 51D, 51D' and bevel gear F21 and is further transmitted to the first transportation gear 52 through gears 51C (51I), 52B and 52A. The first transportation gear 52 is meshable within the main body of the image forming apparatus with the rack 521 formed on the top surface of the developing device 13A. Similarly to the case of the first embodiment, when the developing device 13A is in the inoperative (stand-by) position, the first transportation gear is displaced to such a position where it is engaged with the rack 521, but when the developing device is in the operative position, the first transportation gear 52 is displaced to be in meshing engagement therewith.

Figure 14:
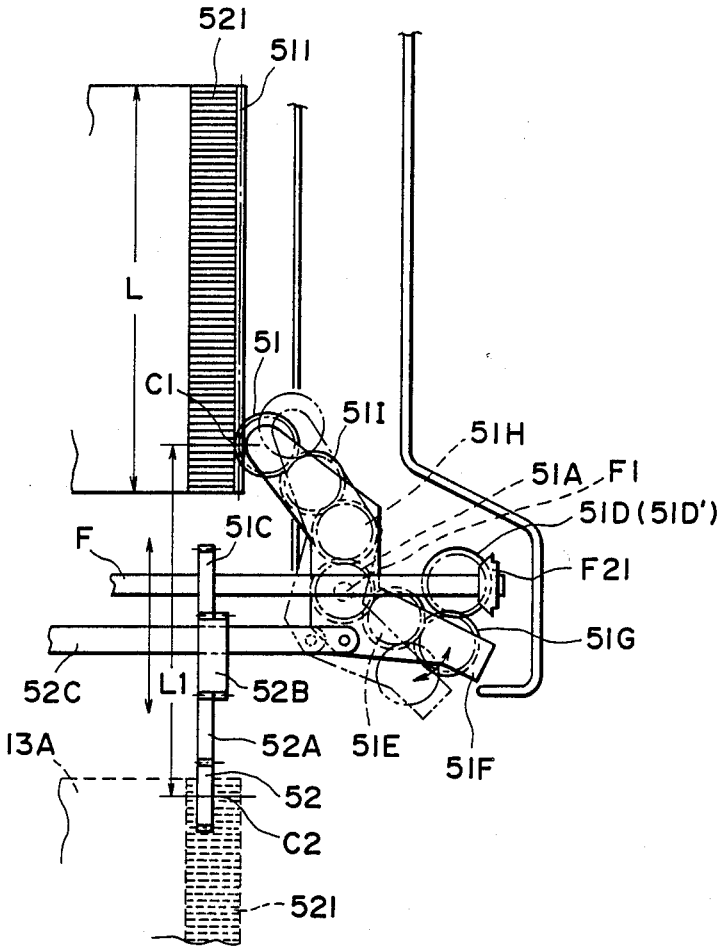
FIG. 14 is a sectional view further illustrating the second example.

When the developing device 13A is transported between the main body X and the accommodating apparatus Y, the solenoid is energized to rotate the plate 51F to a solid line position of FIG. 14, to transmit the driving force from an unshown driving source to the first transportation gear 52 and the second transportation gear 51 so as to transport the developing device 13A through the racks 521 and 511. After completion of the transportation, the solenoid is deenergized to rotate the plate 51F to the chain line position. Then, the engagement between the second transportation gear 51 and the rack 511 is released.

As described in the foregoing, according to this embodiment, the developing device is correctly positioned at the developing operation position, and further it is placed in proper pressure contact with the image bearing member.

Further, in this embodiment, a length of the rack 521 on the top, alternatively or bottom surface of the developing device and the rack 511 on the side thereof, measured along transportation direction of the developing device is larger than a distance L1 between a meshing position C1 between the rack 511 and the gear 51 and a meshing position C2 between the rack 521 and the gear 52 ($L1<L$), in order to further improve the transportation between the image forming apparatus and the developing device accommodating apparatus.

Figure 15:
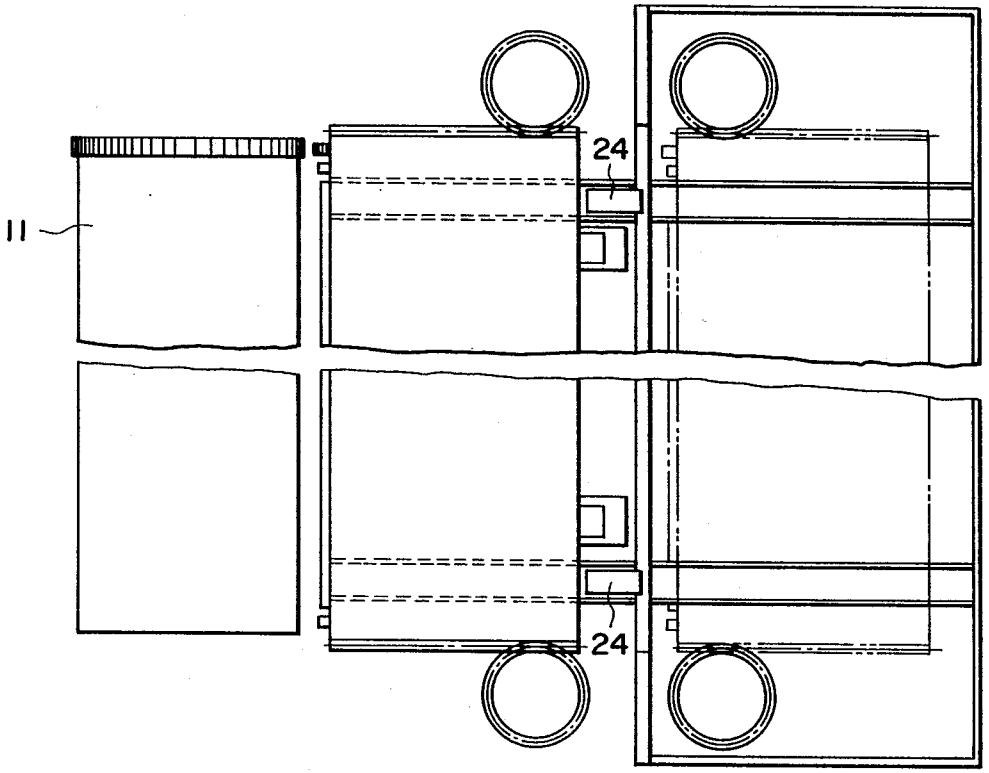
Figure 16:
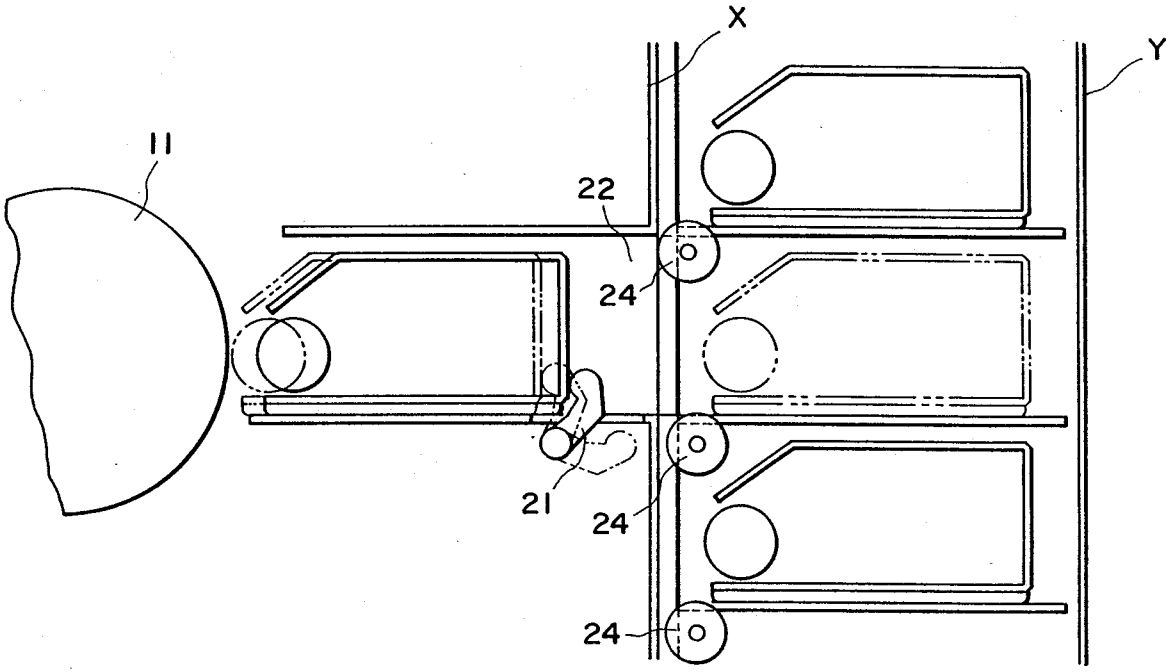
Figure 17:
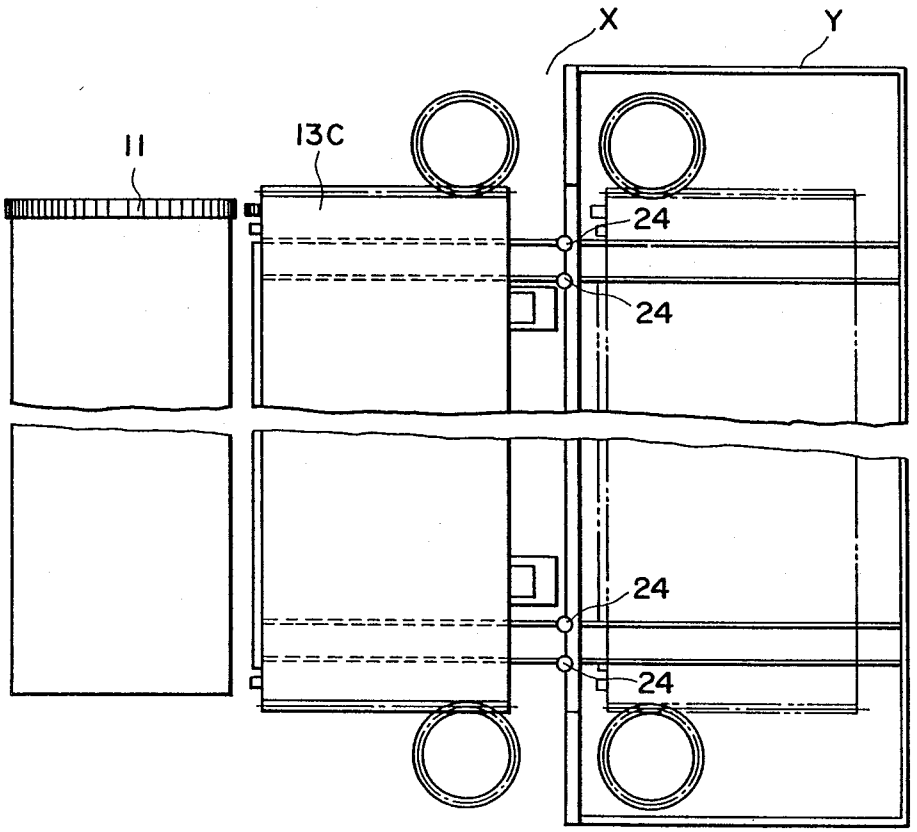

Referring to FIGS. 15–17, description will be made to a structure for accommodating positional deviation at the connecting portion between the image forming apparatus and the developing device accommodating apparatus used therewith, so as to improve the transfer therebetween. The feature in this embodiment is in an intervening member for assisting the transfer of the developing device, disposed in the junction between the guide of the accommodating apparatus and the guide of the main body of the image forming apparatus. In this embodiment, intervening plate and intervening roller are disposed opposed to the bottom surface of the developing device. In FIGS. 15 and 17, the intervening member is provided at the main body of the image forming apparatus, while in FIG. 16 they are provided in the accommodating apparatus.

In FIG. 15, the intervening plate 24 is disposed both to guiding members of the main body and the accommodating apparatus for guiding the projection of the developing device. The function of the intervening plate 24 is similar to the expanded guide portion 272 and 282 explained in conjunction with FIG. 9, which is better than this structure from the practical standpoint.

FIG. 16 shows an example wherein guiding rollers 24 are rotatably mounted to the respective partition stages 151A–151D of the accommodating case Y.

FIG. 17 shows a structure to accommodate the horizontal deviation, the guiding rollers 24 are disposed at both sides of the slide guides of the main body X.

The guiding rollers 24 may be in the form of a freely rotatable rollers or may be rotationally driven by a reversible pulse motor.

By those structures, the transportation between the main body X and the accommodating apparatus can be performed smoothly, so that the developing device supplying performance is improved.

Referring to FIGS. 18–25, the description will be made with respect to the relationship among the main body of the image forming apparatus, the developing device accommodating apparatus and the sheet feeding means, particularly a manual sheet feed means. This embodiment is particularly advantageous when a sheet feeding means is disposed below the accommodating apparatus, but it is advantageous in the other case to prevent the developer from scattering and falling.

Figure 18:
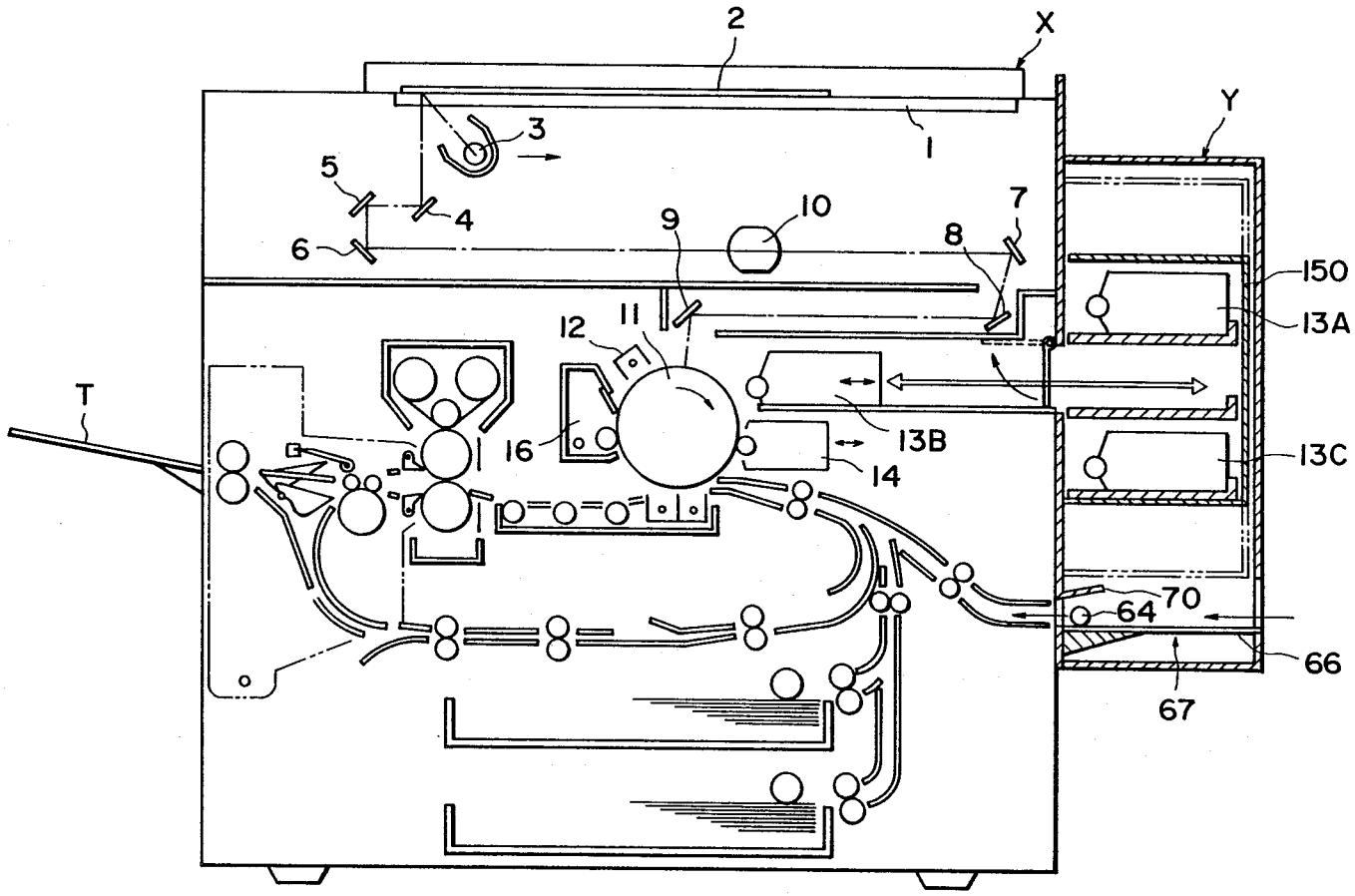
FIGS. 18–23 illustrate a relation between the developing device accommodating apparatus and a mechanism for manually feeding a copy sheet.

In FIG. 18, the image forming apparatus is provided with means for allowing a manual feed of the recording medium, in addition to the construction shown in FIG. 1. The recording medium or sheet manually fed onto the manual feed tray 66 is received in the image forming apparatus by a feeding roller 64. Thereafter, the sheet is advanced to a registration roller 23 by way of guiding plates and roller couples. The manual feed device 67 is formed integrally with the developing device accommodating apparatus B at the lower position thereof. Additionally, integrally mounted to the accommodating apparatus is a member 70 for receiving developer falling from the developing device. The member 70 extends from its base integrally fixed to the accommodating apparatus to its free end and is inclined a little upwardly away from the base end, as shown in FIG. 18. The receiving member 70 is effective to prevent the manual feed of the recording sheet from being contaminated by the developer which can fall from the developing device being moved for the purpose of transfer between the main body of the apparatus and the accommodating apparatus, since it receives the falling developer. FIGS. 22–25 show modifications.

In FIG. 18, the manual feeding device and the falling developer receiving member 70 are fixed below the vertical movable range of the accommodating case 150 in the accommodating apparatus. However, when the number of the developing devices accommodated in the accommodating apparatus Y is large, and therefore, the vertical movable range of the accommodating case 150 is longer, or when the manual feed device is desired to be positioned at as high as possible position, the manual feed device 67 and the falling developer receiving member 70 are desired to be disposed within the movable range of the accommodating case 150.

Figure 23:
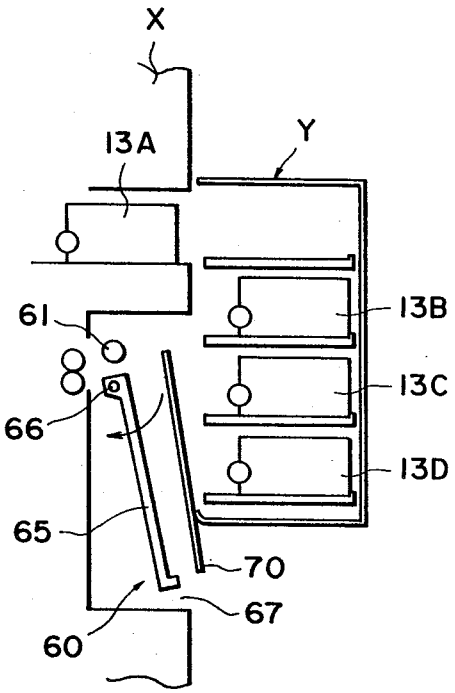
Figure 22:
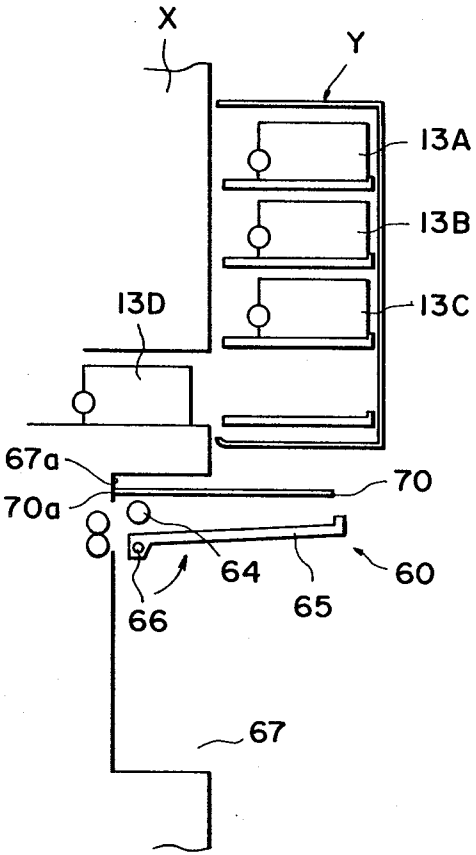

FIGS. 22 and 23 embodiment meet this. In this embodiment, the manual feed tray and the receiving member 70 are movable, but without driving mechanism therefor. As will be understood from FIGS. 22 and 23, the manual feed tray 65 and the developer receiving member 70 are rotated by engagement with the receiving member 70 with the accommodating apparatus Y moving downwardly into a recess of the main body for accommodating the receiving member 70 and the manual feed tray 65. By the accommodating of those into the recess, they are retracted from the interference with movement of the developing device accommodating apparatus Y. More particularly, the manual feed tray 65 and the falling developer receiving member 70 are integrally rotatable about a shaft 66 into the recess 67 of the main body X. They are normally urged by a predetermined moment by an unshown urging means in the direction indicated by an arrow in FIG. 22, that is, in such a direction that the manual feed tray 65 and the receiving member 70 are at the inoperative position, i.e. projected out of the recess. In the state shown in FIG. 22, an end of the receiving member 70*a* is in abutment to a wall 67*a* of the recess 67. Here, the value of the moment is so determined that the manual feed tray 65 does not swing down by a single or plural recording sheets 17 placed thereon.

If required, the accommodating apparatus Y moves down as shown in FIG. 23. When this occurs, the bottom end of the developing device accommodating apparatus Y is brought into contact with the receiving member 70, by which the receiving member 70 together with the manual feed tray 65, is rotated about the shaft 66 in the direction indicated by an arrow in this Figure, so that they are accommodated in the recess 67.

After the desired developing device 13A is set in the main body X of the apparatus, the developing device accommodating apparatus Y is moved upwardly to the original position shown in FIG. 22. Then, the manual feed tray 65 and the receiving member 70 swings back upwardly by the moment provided by the unshown urging means, so that it is reset to the operable position shown in FIG. 22, thus enabling manual feeding operation. As an alternative, the operation of returning the accommodating apparatus Y to the FIG. 22 position may be performed to enable the manual feed operation, only when the manual feed is selected on the operation panel of the image forming apparatus.

Figure 24:
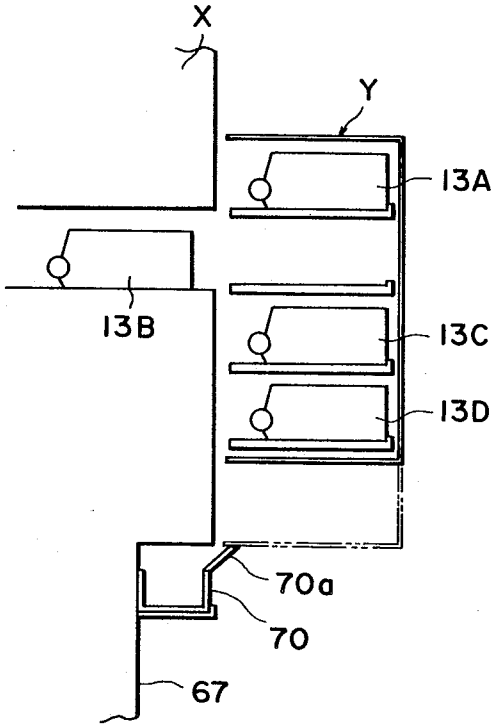

In FIG. 24, a recess or set-back portion is formed at a lower portion of the main body which has the same positional level as in FIG. 18 arrangement, and in the set-back portion, a falling developer receiving member 70 is fixed which is in the form of a container. From the receiving container 70, an elastic resin sheet 70*a* is extended inclinedly. The falling toner is collected in the container along the elastic resin sheet 70*a*. The free end of the elastic resin sheet 70*a* is so positioned that when the developing device accommodating apparatus B comes to the bottommost position, the bottom thereof is contacted to the free end of the elastic resin sheet 70*a*. Then, the toner on the resin sheet 70*a* is efficiently collected into the container 70 by the resulting vibration.

Figure 25:
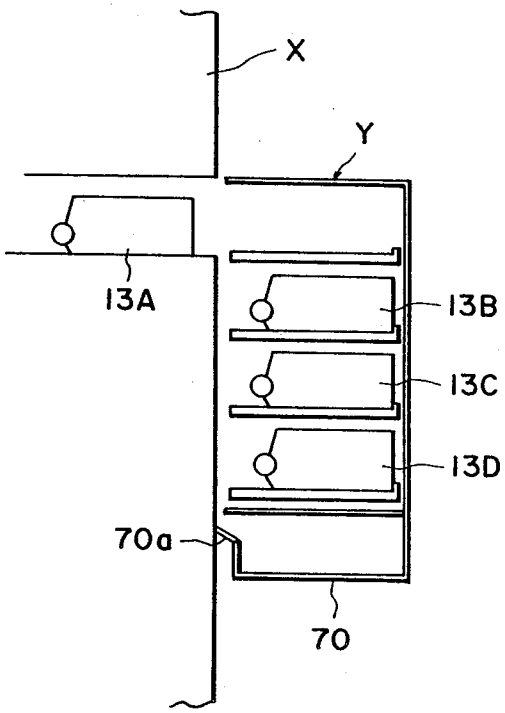
FIGS. 24 and 25 are sectional views illustrating a developer collecting means for developing passages.

In FIG. 25, the bottom of the accommodating case 150 of the developing device accommodating apparatus B is formed into a container 70 for receiving the falling developer, from which the similar elastic resin sheet 70*a* is extended. By this, the falling toner is collected into the container 70 along the elastic resin sheet. It is preferable that the elastic resin sheet 70*a* is contacted to the main body.

Referring back to FIG. 19, the description will be made with respect to a switching mechanism D for selectively transmitting driving force from a single driving source (motor 493) to the manual feed device 67 or to the developing device accommodating apparatus Y. The motor 493 has an output shaft to which a gear 494 is fixed. The rotation thereof is transmitted either to a gear 643 or to a gear 207 through a gear 495 and a swingable gear 208. The swingable gear 208 is mounted on an arm 206 adjacent its end, the arm is in the shape of "L" and being rotatable about a shaft 205 of the gear 495 in the direction indicated by arrows P1 and P2. Another "L" arm 491B which is swingable in the direction indicated by an arrows N1 and N2 about a shaft 491C, is connected to a solenoid 49 at its one end. The other end of the arm 491B is engaged with the other end of the arm 206. The arm 491B is normally urged in the direction N1 by the function of a spring 492 mounted to an end of the arm 491A fixed to the center of the arm 491B, so that the arm 206 is normally urged in the direction P1, and therefore, the gear 208 is normally meshed with the gear 207 as shown by solid lines.

The gear 207 transmits the driving force from the motor to the developer accommodating apparatus or a developing device automatic exchanger B. On the other hand, the gear 643 is effective to transmit the driving force to the manual feed device 67. As shown in FIG.

20, a bevel gear 642 is fixedly mounted to the other end of the shaft 64B of the gear 643, and is meshed with another bevel gear 641, to which a couple of feeding rollers 64 and 64' are fixedly mounted.

Therefore, when the solenoid 49 pulls the arm 491 in the direction M2, the swingable gear 208 shifts in the direction P2 through the arms 491 and 206 to be meshed with the gear 643, by which the rotation of the motor 493 is transmitted to the bevel gears 642 and 641 through the gears 494, 495, 208, 643 and shaft 64B, and further to the feeding rollers 64 and 64 through the shaft 215. Thus, a recording medium or sheet 17 placed on the manual feed tray 66 is inserted into the main body A.

Figure 26:
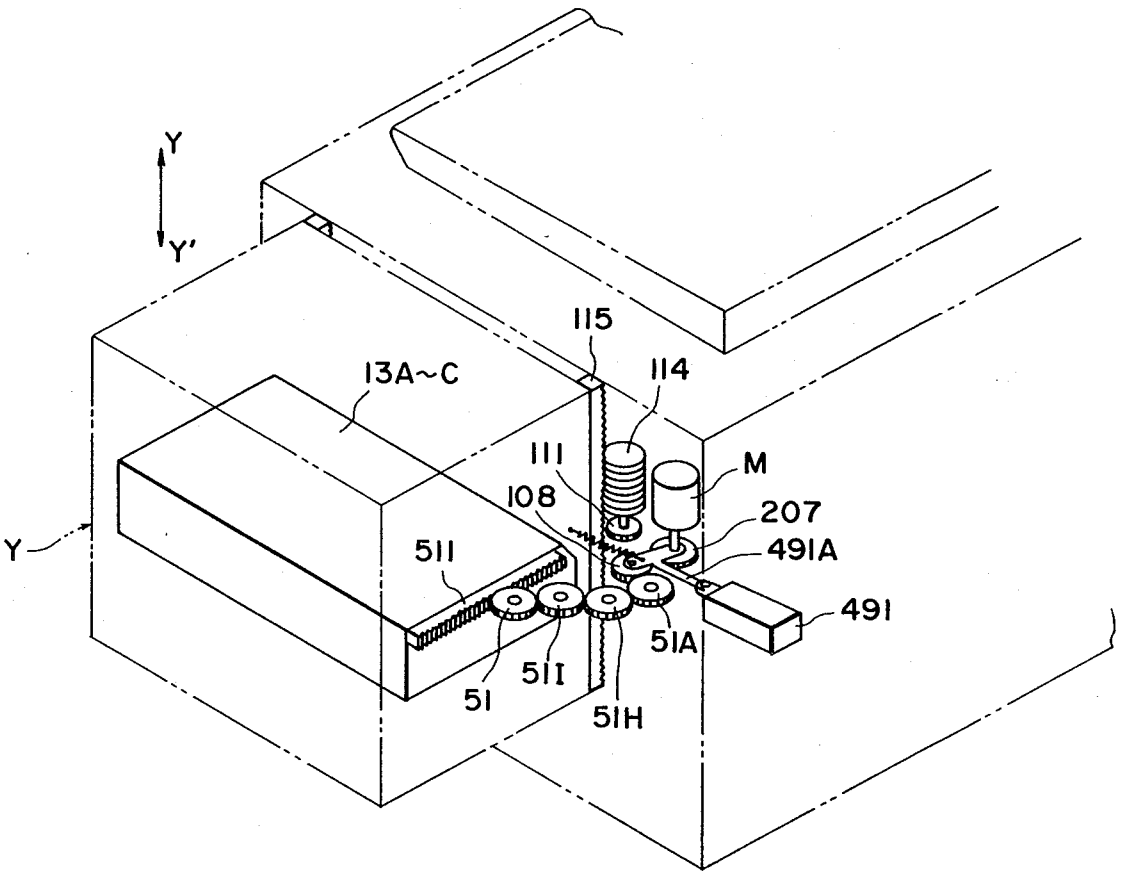
FIG. 26 is a perspective view of an apparatus which is a modification of FIG. 21 apparatus.

Referring to FIGS. 21 and 26, the description will be made as to a further example of the developing device automatic exchanger Y. The automatic exchanger Y includes a developing device accommodating case 150 for accommodating a plurality of developing devices 13A, 13B and 13C and driving means C for vertically driving the accommodating case 150 as a whole (in the direction indicated by Y-Y') and also for transporting a selected developing device 13B, for example toward the image forming station in a direction indicated by X-X'.

The driving means C is applicable to the arrangements shown in FIG. 14 and in FIG. 32 which will be described hereinafter. As shown in FIG. 21, the driving means C includes a solenoid 491 which has a rod 491A movable in directions indicated by arrows a-a' as shown in FIG. 21. To a free end of the rod 491A, a swingable lever having a shape of "L" is rotatably mounted on a pin 107. An end of the swingable lever 106 is journaled to a shaft 105*a* of the gear 105, and adjacent the other end of the lever 106, a gear 108 is mounted for rotation in a horizontal plane, the gear 108 being normally meshed with the gear 105. The gear 105 is meshed with the gear 207 (FIG. 19) adjacent an end of the switching mechanism D.

Adjacent the gear 108, there are gears 111 and 51A which are rotatable in a horizontal plane and which are to be selectively meshed with the gear 108. A worm gear 114 is fixed to a rotational shaft supporting the gear 111 as shown in the Figure. The worm gear 114 is meshed with a rack 115 extending substantially vertical on an end of the developing device accommodating case 150 near the main body. The gear 51A is meshed with a gear 51 for moving the developing device in X-X' direction through the gears 51H and 51I which are rotatable in a horizontal plane. The gear 51 is meshed with a rack 511 formed on a side of the developing device 13B.

The swingable lever 106 is swingable about a shaft 105*a* of the gear 105 in the direction of b-b'. The swingable lever 106 is normally urged by a return spring 120 in the direction b, and when the solenoid is not energized, the gear 108 mounted thereto is meshed with the gear 111, as shown in FIG. 21.

Figure 19:
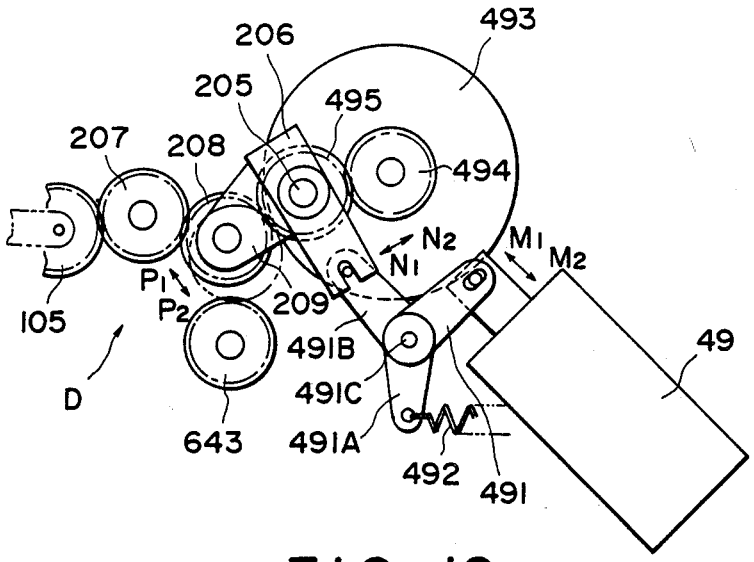
Figure 20:
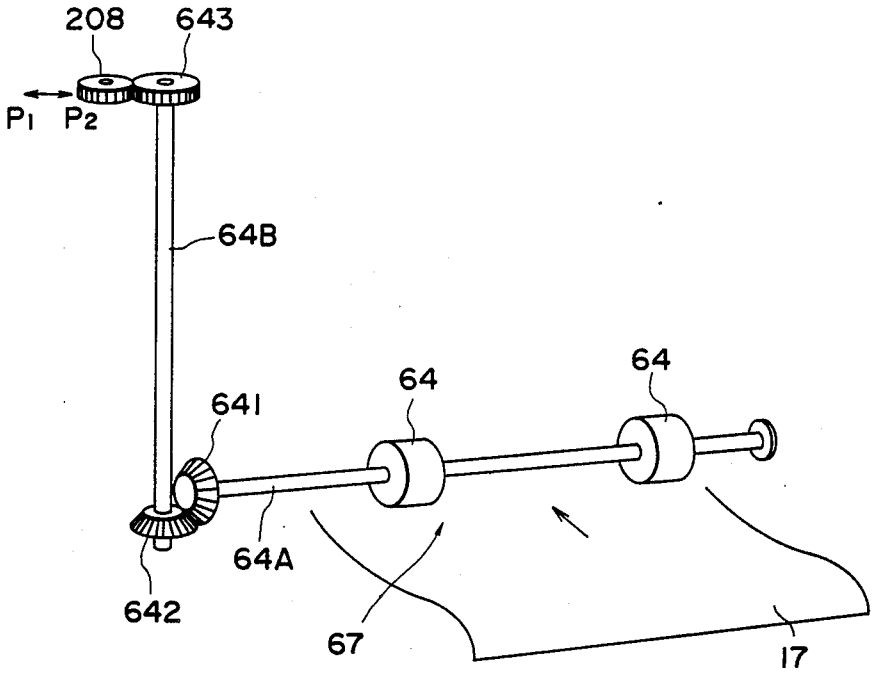

Then the motor 493 is rotated in the forward direction by an unshown control means with the swingable gear 208 of the driving mechanism D meshed with the gear 207, as shown in FIG. 19, and with the gear 108 shown in FIG. 21 meshed with the gear 111, the rotation of the motor is transmitted to the worm 114 through the gears 207, 208, 495, 494, 105, 108 and 111 and the shaft 113 to rotatingly drive the worm 114, by which the accommodating case 150 provided with the rack 115 meshed with the worm 114 is moved in Y direction, for example, upwardly. If the motor is reversely rotated, the accommodating case 150 moves in the Y' direction, that is, downwardly. In this manner, the accommodating case 150 is moved up and down, and therefore, one developing device having a desired color developer selected from the developing devices in the accommodating case 150 is brought to be opposed to an unshown developing device inlet of the main body X, by stopping the motor 493 at this position. Thereafter, the control means 400 of FIG. 6 drives the solenoid 49 to retract the rod 491*a* in the direction a'. Then, the swingable lever 106 swings about the shaft 105*a* in the direction B' together with the gear 108 against the spring force of the return spring 120, and as shown in FIG. 26, the gear 108 is switched to be meshed with gear 51A from with the gear 111. When the motor 493 is rotated forwardly with this state, the rotation is transmitted to the X-driving gear 51 through the gears 207, 105, 108, 51A, 51H and 51I, so that the X-driving gear 51 is driven, by which the developing device provided with the rack 511 meshed with the X-driving gear 51 is transported in the direction X into the image forming station of the main body X of the image forming apparatus. If, on the other hand, the motor 493 is rotated reversely, the driving device is transported back from the image forming station in the direction X' into the developing device accommodating case 150.

By repeating the above described operations, the developing device can be automatically exchanged.

As described in the foregoing, in this embodiment, the automatic developing device exchanger and the manual feed device are prevented from operating simultaneously, and therefore, the toner scattering or image disturbance which can be resulted from the movement of the developing device can be avoided, and also an erroneous image forming operation can be avoided, thus providing good quality images.

It is possible that separate driving means are provided respectively for the driving means for vertically moving the developing device accommodating case 151, the driving means for transporting the selected developing device 101 from the developing device accommodating case to the image forming station and the means for driving the manual feeding device, but it requires that three or more reversible pulse motors are employed, with the result that the cost is increased, that the apparatus becomes complicated and bulky and that the control system is complicated. For this reason, the above described embodiment is preferable in that the driving force is positively transmitted to proper means with timed relationship so that the developing device is protected from possibility of damage. The control system for the driving of the apparatus according to the present invention may be in the form of the following. It comprises a driving source for driving the developing device accommodating device for accommodating a plurality of developing devices, wherein the driving source is commonly used to supply the selected one of the developing devices to the image forming station, and it also comprises switching means for switching the drive transmission between from the driving source to the developing device accommodating device driver and from the driving source to the developing device transportation driver. According to this structure, the automatic developing device exchanger may be simplified and can be reduced in size with the advantage that the possibility of transmitting the driving force to both directions can be prevented (if the drive is transmitted to both directions, the accommodating case or the developing device will be damaged).

The later described type of the horizontal driving mechanism for the developing device (FIGS. 9–14, 15, 17, 21 and 32) is advantageous over the former described type of the horizontal driving mechanism (FIGS. 2–4), since in the latter type, the driving force is applied to both lateral sides of a developing device with respect to its transportation direction so that the transportation is stabilized, as contrasted to the former case wherein the driving force is imparted in a single line, and since if a rack and gear mechanism is used for the drive transmission the driving force applied to the respective sides are substantially equal.

Referring back to FIGS. 8 and 21, the features of the driving mechanism are as follows:

(1) Substantially the same driving forces are applied to the respective lateral sides of the developing device with respect to the transportation direction thereof.

(2) To do this, the first and second drive transmission means are provided to apply substantially the same driving forces to the lateral sides thereof.

(3) The developing device is provided with first and second drive receiving members at both lateral sides.

By those features, the developing device is transported while receiving substantially the same driving forces at both lateral sides thereof. Thus, the developing device can be transported stably and smoothly without inclination with respect to the transportation direction.

Further, referring back to FIG. 8, the "L" shaped lever 27 functions to lock the developing device accommodated in the accommodating apparatus in the state shown in FIG. 8, and is actuatable by the solenoid 28 to be retracted out of the developing device passage.

Figure 33:
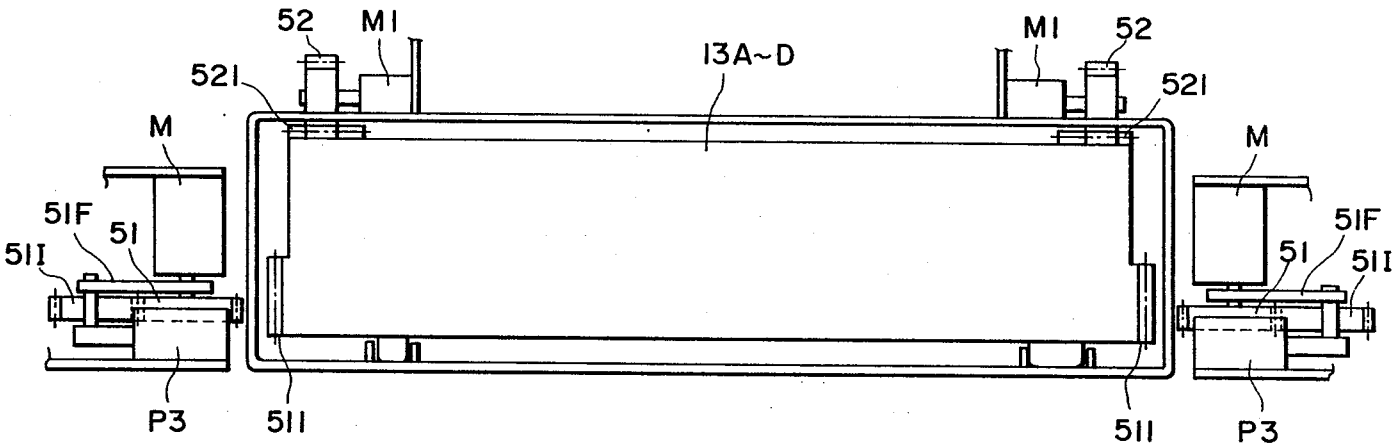
FIG. 33 is a sectional front view in a structure according to FIGS. 32 and 13.
Figure 36:
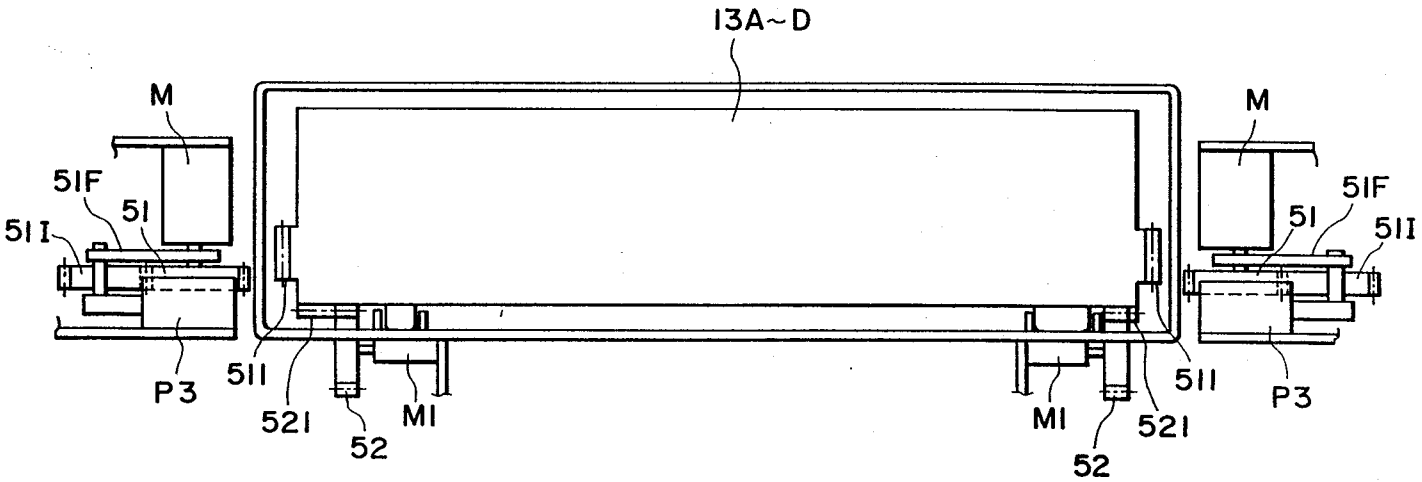
FIG. 36 is a side view illustrating FIG. 35 embodiment.

As shown in FIG. 12 and FIGS. 33 and 36 which will be described hereinafter, the horizontal driving mechanism for driving the developing device in a horizontal plane in the accommodating apparatus and the image forming apparatus, is provided to each of the lateral sides of the developing device with respect to the developing device transportation direction so that substantially the same driving force is transmitted to the both sides by dividing the horizontal driving mechanism into the first and second transmitting means. The first and second transmitting means may be provided at the top and bottom surfaces, respectively. In any event, the first and second transmitting means is formed by substantially the same rack-pinion mechanism of substantially the same design (511-51, 521-52) so as to transmit the same driving forces to both sides. The gear-and-rack mechanism smoothly transports the developing device, and the guiding means (concave) and the intervening members further stabilize the transportation.

Referring to FIGS. 27–31, a safety mechanism used with the apparatus according to the present invention will be described. In the image forming apparatus described in the foregoing, the driving mechanism for the vertical movement of the developing device accommodating apparatus is of both-way type, and therefore, when the motor stops by, for example, power shutdown, the driving source is unintentionally driven by the weight of the developing device accommodating apparatus, with the result that the apparatus falls. In this embodiment, a control member is provided to limit movement of the accommodating apparatus. Because of the provision of the control member, the accommodating apparatus is prevented from falling by its own weight, even if the driving source is shut down for some reason or another, since the control member is effective to allow the transmission of the driving force between the driving source and the accommodating apparatus only in one direction. The driving means C includes a pulse motor M reversely actuatable by a motor driver O, and the output shaft of the pulse motor M is upstanding as shown in the Figure. Adjacent its end a worm gear 114 functioning as the control member is formed to establish the one-way property in the drive transmission from the pulse motor M. The worm gear 114 allows only the drive transmission from the pulse motor M to the accommodating apparatus Y. The worm gear 114 is always in meshing engagement with the rack 115 formed on the end of the accommodating apparatus B.

By this worm gear mechanism, the drive transmission is allowed only from the rotation of the worm 114 to the linear movement of the rack 115, but the reverse transmission from the linear movement of the rack 115 to the rotational movement of the worm gear 114 is prohibited. Therefore, even if the pulse motor M shuts down due to power source failure or the like during the driving by the pulse motor M, the worm gear 114 is not rotated through the rack 115 by the weight of the accommodating apparatus, so that the accommodating apparatus Y is prevented from falling by its own weight.

Figure 27:
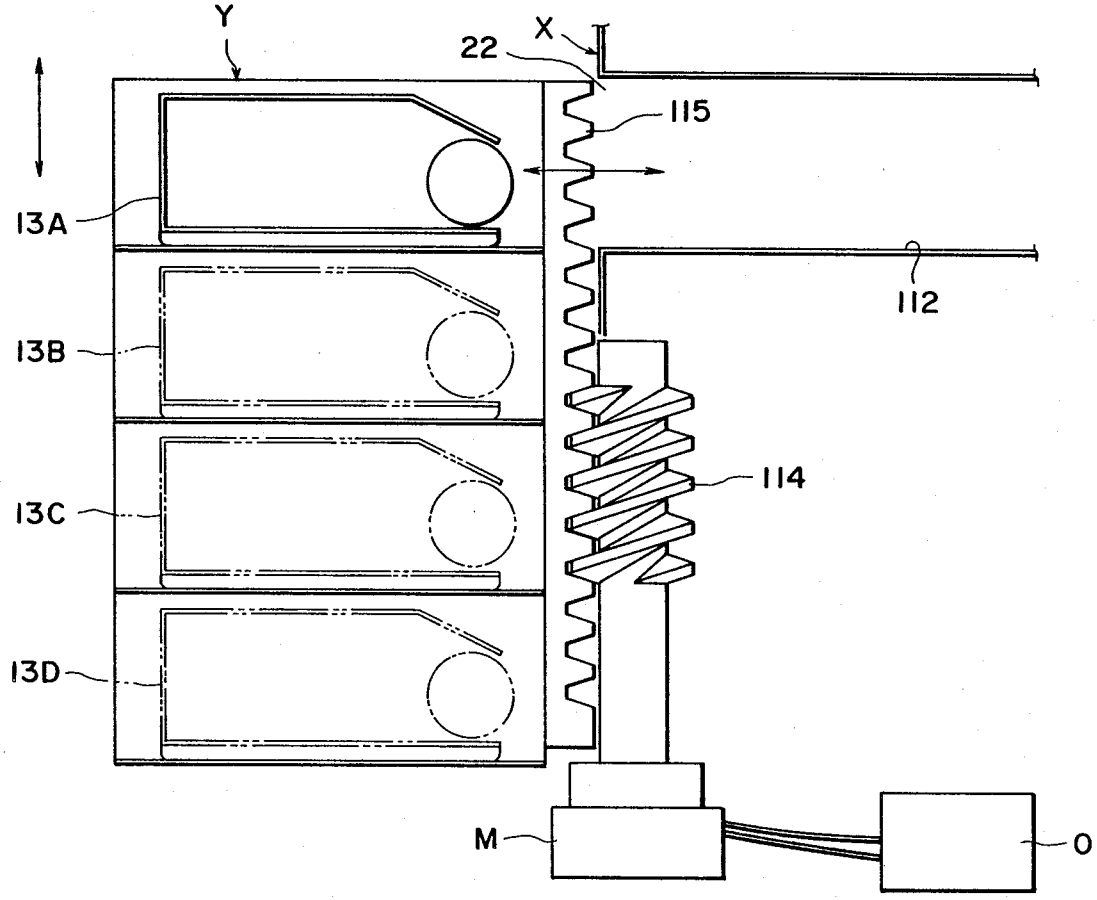
FIGS. 27–31 illustrate a safety mechanism for the apparatus for accommodating plural developing devices.
Figure 28:
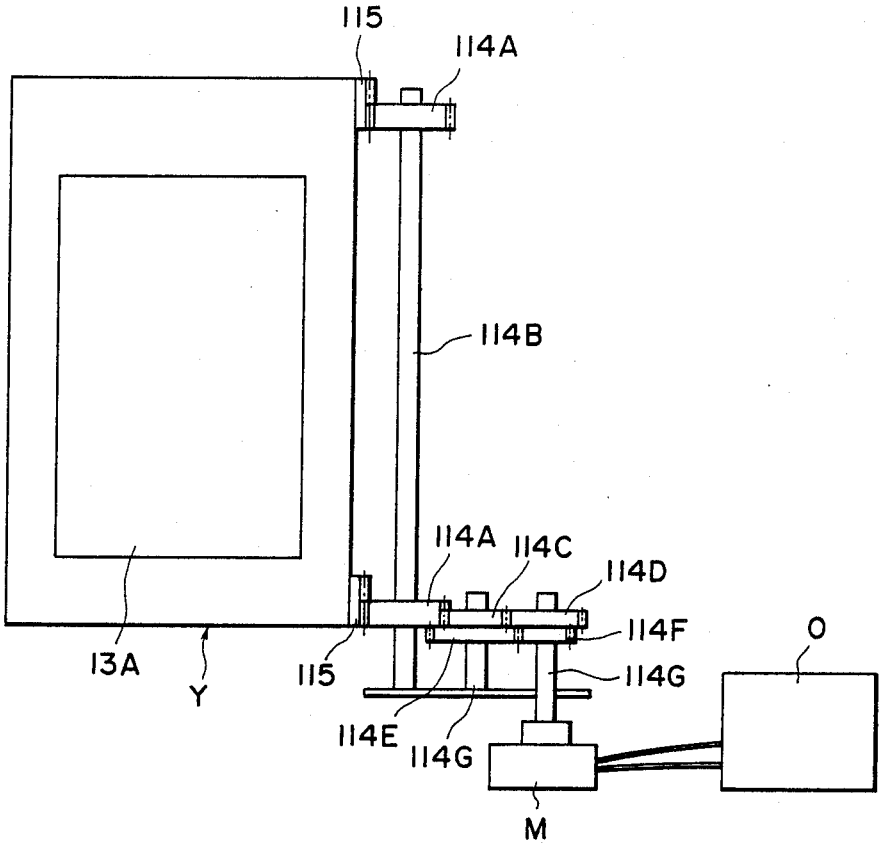

Referring to FIG. 28, a modification of FIG. 27 arrangement is shown in a top plan view. In this modification, a step gear mechanism is employed in the driving means C' for driving vertically the accommodating apparatus Y. A resistance resulting from a reduction function provided by the step gear mechanism is utilized to prevent the accommodating apparatus Y from falling by its weight.

The pulse motor M constituting the driving means C' has an output shaft 114G which is provided with large and small diameter gears 114A and 114F fixed thereto. The small diameter gear 114F is meshed with a large diameter gear 114E rotatably supported on a shaft 114G' fixed to the main body X. Additionally, to the shaft 114G', a small diameter gear 114C is rotatably supported, and the gear 114C is meshed with a gear 114A fixed to a long shaft 114B extending parallel to the shaft 114G'. To an end of the shaft 114B, a gear 114A having the same diameter as that of the gear 114A is fixed, and those gears 114A and 114A are meshed with racks 115 and 115 extending substantially vertically at both sides of the accommodating apparatus Y. The rotation of the motor M is transmitted to the gear 114A with the two step reduction (in this embodiment, it is reduced to about 1/40). When the pulse motor M stops due to power source failure or the like, the weight of the accommodating apparatus Y tends to rotate the gears 114A and 114A meshed with the racks 115 and 115, respectively, however, the drive transmission from the gear 114A to the pulse motor M must involve increasing the speed, and therefore, a large resistance against the transmission. As a result, the gears 114A and 114A are not rotated, so that the developing device accommodating apparatus Y is prevented from falling due to its own weight.

Figure 29:
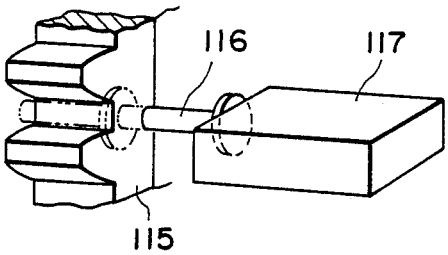
Figure 30:
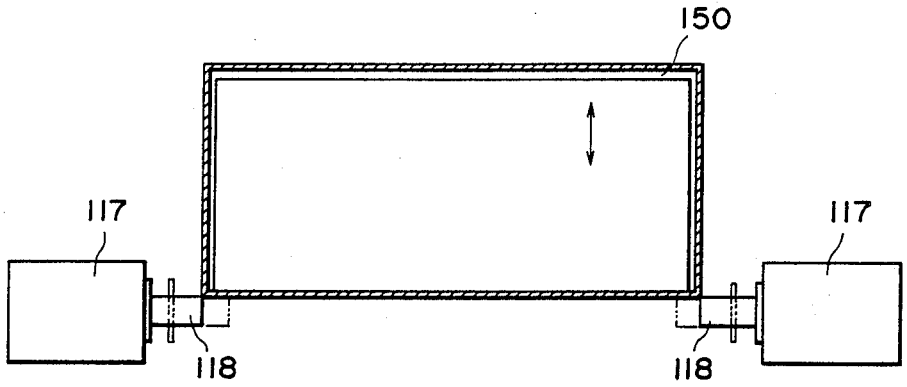

Referring to FIGS. 29 and 30, a stopper is employed for the same purpose. The stopper is engageable with the rack 115 (FIG. 29) and the bottom of the accommodating case 150 (FIG. 30). The stopper is moved upon power failure or the like by the control means 117 which effects movement of the pins 116 and 118 by deenergization of a solenoid to prevent the falling of the accommodating case.

Figure 31:
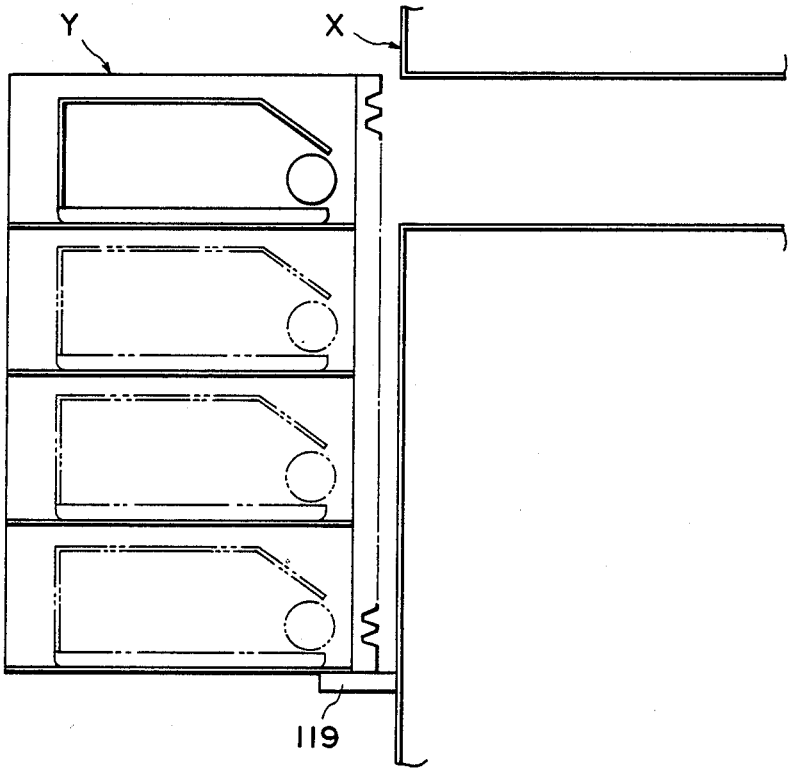

In FIG. 31, a mechanical stopper 119 is disposed to engage the bottom of the accommodating case 150 when it takes the bottom most position for the developing device transportation. The stopper is provided in the main body of the image forming apparatus. By those means, the accommodating apparatus is positively prevented from falling by its own weight even upon the failure of the driving source for one reason or another.

Figure 32:
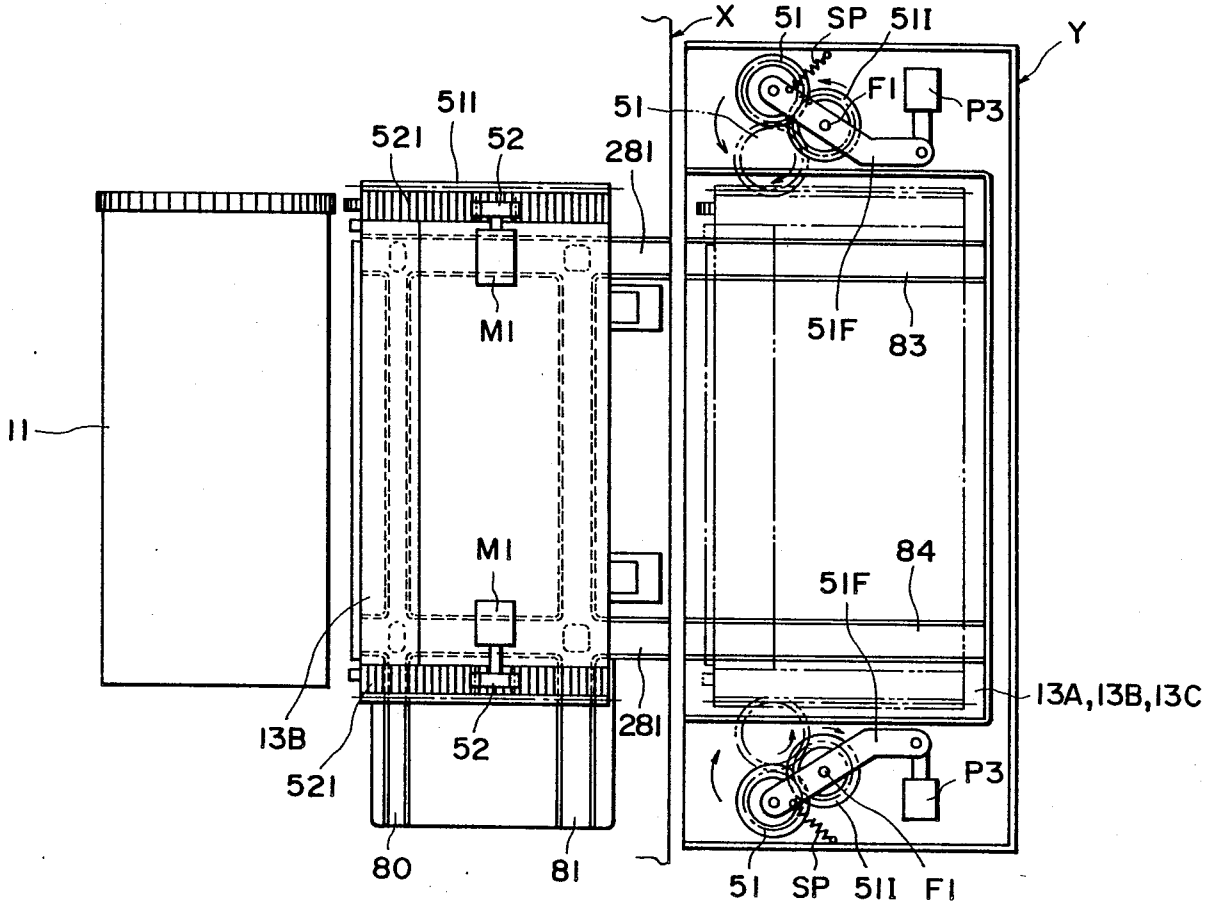
FIG. 32 illustrates a modification of FIGS. 13 and 14 structures.

Referring to FIG. 32, the description will be further made as to the structure for additionally allowing the developing device to be mounted into or demounted from the apparatus at the main body of the image forming apparatus together with the description of a further preferable structure of the developing device.

In this embodiment, the developing device transporting means within the main body of the image forming apparatus for transporting the developing device to the image forming station is constituted by a rack formed on the top or bottom surface of the developing device, a gear engageable therewith and a motor for driving the gear. Because of this structure, the developing device can be easily mounted or demounted.

The driving mechanism within the accommodating apparatus includes a gear 51 displaceable by the lever 51F connected to the solenoid P3 between the operative position for engagement with the rack 511 and a retracted disengagement position, and the gear 51I rotatable about the fixed shaft F1 for transmitting the driving force thereto. The driving mechanism operates at the timing described hereinbefore. The driving mechanism within the main body of the image forming apparatus is disposed above the developing device. In the main body, guiding passages 80 and 81 extend in the direction perpendicular to the direction of movement of the developing device toward and away from the image forming station. That one 80 of the driving passages which is near the photosensitive member 11 is narrower than the other. Those passages are associated with projections indicated by broken lines formed on the bottom of the developing device, and they function as a fool-proof means to assure that a developing sleeve side of a developing device is faced to the photosensitive drum 11.

As compared with the structure shown in FIG. 9, the developing device 13B can be retracted out of the main body of the apparatus X only by being pulled out (downward in FIG. 32) along the guides 80 and 81, without a large-scaled releasing operation from the driving mechanism (solenoid M1 and gear 52). Therefore, the mechanism of the image forming apparatus can be simplified.

In FIGS. 32, 14 and 21 and FIGS. 34 which will be described hereinafter, it is not necessary to provide the conveying means in the accommodating apparatus for each of the accommodating stages, as contrasted to FIG. 11 arrangement. The retraction of the conveying means can be accomplished with a simple structure and by a slight displacement of the gears 51 and 51 in the longitudinal direction of the developing device. Therefore, the accommodating device Y can be made smaller and more simplified. This leads to small size and simplified structure of the image forming apparatus equipped with the developing device accommodating apparatus Y as a whole can be accomplished.

Figure 34:
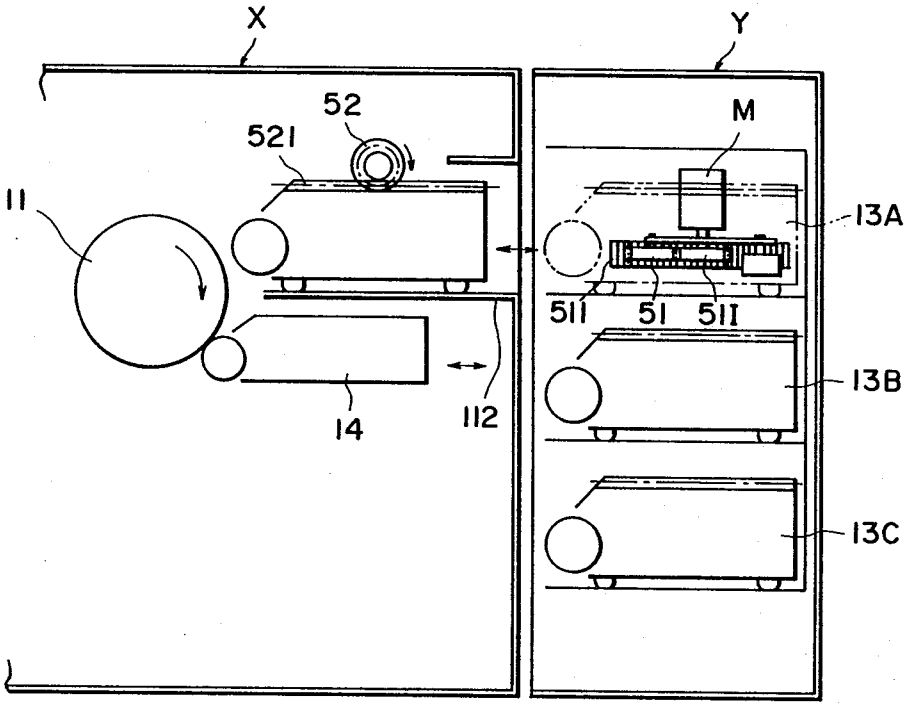
FIG. 34 is a sectional front view illustrating a second example of the developing device moving means in accordance with FIG. 32 structure.

Referring to FIG. 34, where a black developing device 14 which is usually used most frequently is provided below the developing device transportation passage, that is, below the developing device 13A in this Figure, the driving mechanism within the image forming apparatus is preferably disposed above the developing device 13A, since otherwise, that is, when the driving mechanism is disposed below the developing device 13A, the developing device 14 has to be disposed further below, which will influence image forming conditions and would result in deterioration of the image.

Figure 35:
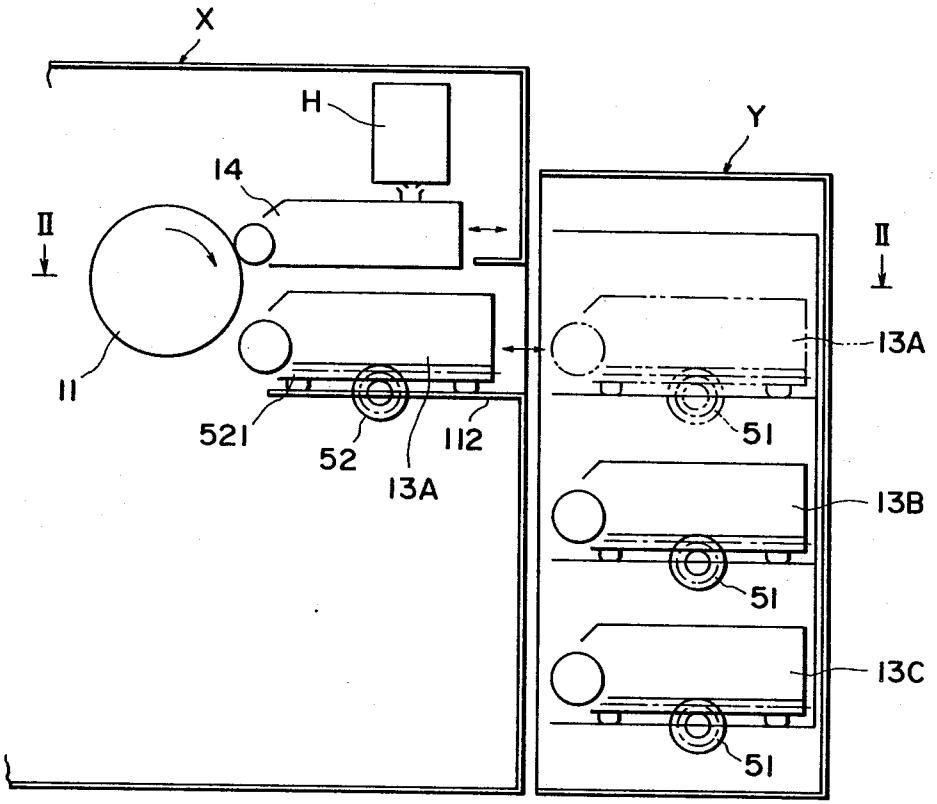
FIG. 35 is a front sectional view of a part of an image forming apparatus according to another embodiment of the present invention.

Referring to FIGS. 35 and 36, there is shown an arrangement wherein a hopper H for supplying replenishing developer into the black developing device 14 is disposed so as to avoid interference with the first conveying means 52.

Additionally, when, for example, the green developing device 13A requires maintenance or toner supply, the green developing device 13A is pulled out along the developing device guides 80 and 81 (FIG. 32) without the necessity of retracting the gear 12 or the like, then it is taken out of the main body of the image forming apparatus. Thus, the mechanical arrangement of the main body X can be simplified.

Further, in this embodiment, the black developing device containing one component magnetic developer is disposed at an upper level, whereas a chromatic developing device 13A (13B, 13C) containing two component non-magnetic toner is disposed at a lower level, and therefore, it can be avoided that the image density is decreased as a result of dark decay of the photosensitive member and that the damage to the sleeve, erroneous operation and occurrence of void in an image result from carrier deterioration.

Figure 37:
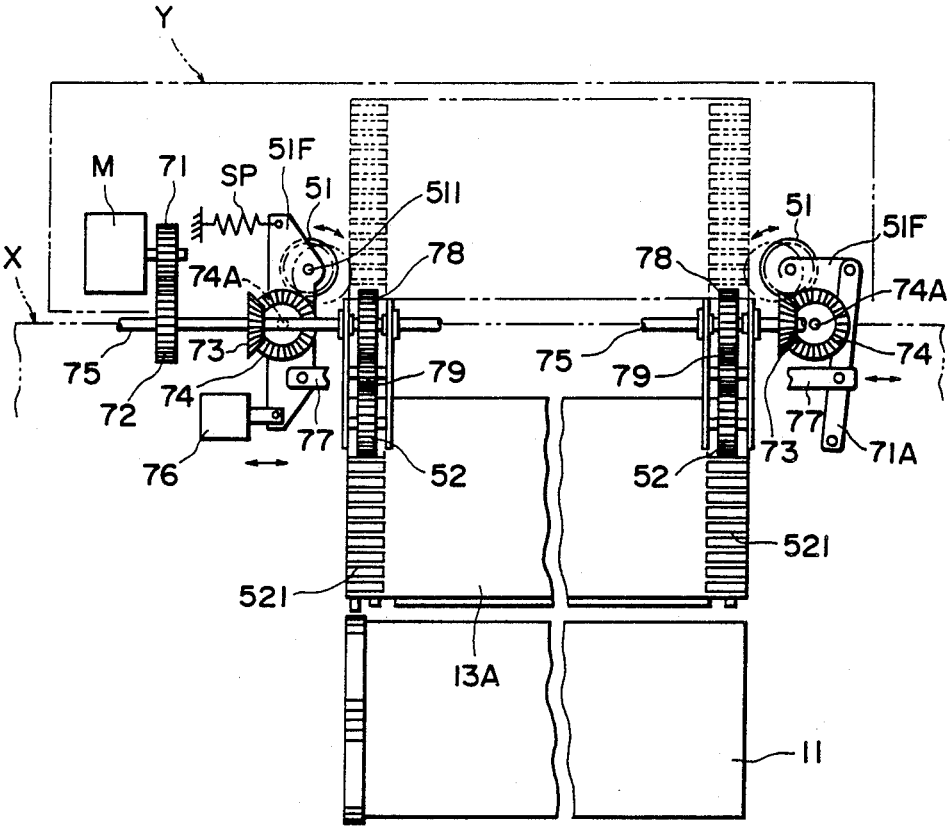
FIGS. 37 and 38 illustrate a third example of the moving means.
Figure 38:
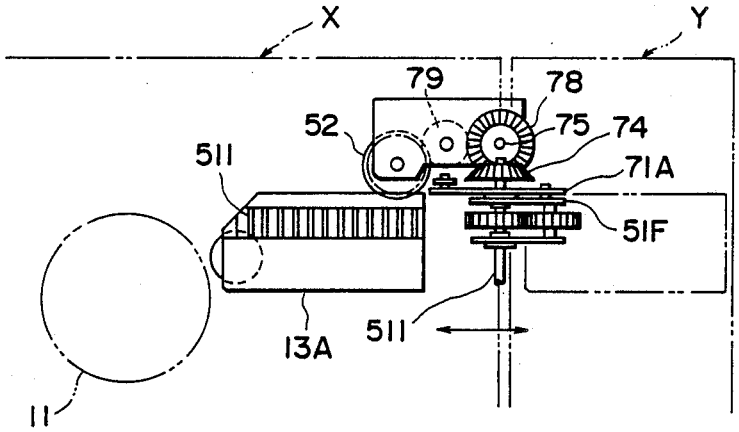

Referring to FIGS. 37 and 38, there is shown a structure wherein the developing device driving or containing mechanisms provided in the main apparatus X and the accommodating apparatus Y are linked by gear when they are joined. Because of this structure, the driving motor can be made common to both apparatuses. Additionally, according to this example, the developing device can be moved correctly synchronously.

To transport the developing device to the image forming station in the neighborhood of the photosensitive drum 1 in the main body X of the apparatus, a couple of conveying means (left and right) are provided. To that one of the conveying means of the accommodating apparatus Y which is near the motor M, a DC motor M is fixed as a driving source, and the rotation of its output shaft is transmitted to a transmission shaft 75 through gears 71 and 72. The rotation of the transmission shaft 75 is transmitted to shafts 74A and 74A through bevel gears 73 and 73, 74 and 74 disposed at the respective sides, and is further transmitted to a gear 51 mounted to levers 51F through the gear at the lower position of FIG. 38. The lever 51F is mounted to the shaft 74A for rotation in a horizontal plane. To one end of one of the levers 51F, an operation rod of the solenoid 76 is mounted, whereas to the other end, a spring SP is mounted. To the other lever 51F, a link 71A is pivotably mounted adjacent an end thereof, and the other end of the link 71A is pivotably mounted to the accommodating apparatus Y. The link 71A and said one of the levers 51F is connected by a link 77.

In the middle of the transmission shaft 75, there are mounted left and right gears 78 and 78. The rotation of the transmission shaft 75 is transmitted to the gears 52 and 52 which are meshed with racks 521 and 521 formed on both sides of the top surface of the developing device 13A, through the gears 78 and 78 and gears 79 and 79. At both sides of each of the developing devices 13A, 13B and 13C, the similar racks are formed for engagement with the gears 51 and 51.

Upon operation of the solenoid 21, the gear 51 is brought to meshing engagement with the rack 511, and the DC motor M is actuated, and then the gears 51 and 52 at both sides are driven simultaneously. By this, the developing device is transported toward the image forming apparatus. When the leading end of the developing device 13A reaches the gears 52 and 52, the gears 52 and 52 are meshed with the racks 521 and 521, by which the transportation of the developing device 13A is continued until the developing device 13A is placed in position in the image forming station.

As described in the foregoing, according to this embodiment, a single driving source (DC motor M) may be used for driving plural driving means for conveying the developing device in synchronization.

In the foregoing description, the driving mechanism containing the DC motor (driving source) is disposed in the accommodating apparatus Y, but it may be disposed in the main body of the image forming apparatus, and the conveying means may be divided into the accommodating apparatus side mechanism and a main body side mechanism.

As for the driving source, a motor for this particular purpose may be utilized, or another motor in the main body X may be utilized in which case, the driving force is taken out as desired through a transmission mechanism such as a clutch or the like.

While the invention has been described with reference to the structures disclosed herein, it is not confined to the details set forth and this application is intended to cover such modifications or changes as may come within the purposes of the improvements or the scope of the following claims.

What is claimed is:

1. An apparatus for accommodating a plurality of developing devices, comprising:

an accommodating case movable substantially vertically, including plural partition stages arranged vertically for movably accommodating the plural developing devices and a drive receiving member for fixedly supporting said partition stages and for receiving driving force in a substantially vertical direction;

a moving mechanism for engaging with a selected one of the developing devices on the partition stages to move the selected developing device relative to the partition stage in a horizontal plane;

means for mounting said accommodating apparatus to an image forming apparatus with which said accommodating apparatus is used; and means for detecting colors of the developers contained in the developing devices.

2. An apparatus according to claim 1, further comprising a driving source for providing a substantially vertical driving force and a substantially horizontal driving force and means for switching drive transmission between the vertical drive and the horizontal drive.

3. An apparatus according to claim 1, further comprising means for preventing a said developing device from being introduced to a said partition stage which accommodates another of said developing devices.

4. An apparatus according to claim 1, wherein said moving mechanism includes a drive transmission member for each of said partition stages.

5. An apparatus for accommodating a plurality of developing devices, comprising:

an accommodating case movable substantially vertically, including plural partition stages arranged vertically for movably accommodating the plural developing devices and a drive receiving member for fixedly supporting said partition stages and for receiving driving force in a substantially vertical direction;

a moving mechanism for engaging with a selected one of the developing devices on the partition stages to move the selected developing device relative to the partition stage in a horizontal plane;

means for mounting said accommodating apparatus to an image forming apparatus with which said accommodating apparatus is used;

means for feeding a sheet to said image forming apparatus, said feeding means being disposed below a lowermost one of the partition stages; and a driving source for driving said feeding means and said accommodating case and switching means for switching transmission of the driving force between said feeding means and said accommodating means.

6. An apparatus according to claim 5, further comprising a member for collecting developer fallen from the developing devices, said collecting member being disposed above said feeding means and below the lowermost of said partition stages.

7. An apparatus for accommodating a plurality of developing devices, comprising:

an accommodating case movable substantially vertically, including plural partition stages arranged vertically for movably accommodating the plural developing devices and a drive receiving member for fixedly supporting said partition stages and for receiving driving force in a substantially vertical direction;

a moving mechanism for engaging with a selected one of the developing devices on the partition stages to move the selected developing device relative to the partition stage in a horizontal plane; and means for mounting said accommodating apparatus to an image forming apparatus with which said accommodating apparatus is used;

wherein each of said developing devices accommodated in said accommodating apparatus is provided with racks at respective lateral sides thereof with respect to a movement direction of the developing devices, wherein said moving mechanism includes drive transmission gears which are meshable with the racks.

8. An apparatus according to claim 7, the racks are provided on the lateral vertical surfaces of each of the developing devices extending in the movement direction thereof, and wherein said gears are engaged with and disengaged from the respective racks simultaneously, and are effective to transmit substantially the same driving forces thereto.

9. An apparatus according to claim 8, wherein a part of the lateral surface is projected, and said accommodating case is provided with a recess for guiding the projection.

10. An apparatus for accommodating a plurality of developing devices, comprising:

an accommodating case movable substantially vertically, including plural partition stages arranged vertically for movably accommodating the plural developing devices and a drive receiving member for fixedly supporting said partition stages and for receiving driving force in a substantially vertical direction;

a moving mechanism for engaging with a selected one of the developing devices on the partition stages to move the selected developing device relative to the partition stage in a horizontal plane;

means for mounting said accommodating apparatus to an image forming apparatus with which said accommodating apparatus is used; and a guide in a substantially concave shape, for guiding a projection provided on each of the developing devices, and wherein an end of the guide near said image forming apparatus is expanded.

11. An image forming apparatus, comprising:

an image bearing member;

means for forming a latent image on said image bearing member;

a conveying passage extending toward said image bearing member to guide a developing device;

a first moving mechanism for engaging with the developing device in said conveying passage and moving it in a substantially horizontal plane;

said image bearing member, said latent image forming means, said conveying passage and said first moving mechanism being provided in a main body of said image forming apparatus;

a device for accommodating a plurality of developing devices, said accommodating device being detachably mountable to said main body, said accommodating device including;

a second moving mechanism for moving the developing device opposed to said conveying passage into said conveying passage in a substantially horizontal plane and an accommodating case having partition stages arranged substantially vertically for accommodating plural developing devices and movable together with the developing devices accommodated therein; and driving means for transmitting a driving force selectively to said first driving mechanism, said second driving mechanism and said accommodating case.

12. An apparatus according to claim 11, wherein said driving means is provided with an interface for transmitting a signal from said main body to said accommodating device, and for transmitting a signal from said accommodating device to said main body.

13. An apparatus according to claim 11, wherein said main body is provided with a shutter for closing and opening said conveying passage, said shutter being opened when one of the developing devices passes between said conveying passage and said accommodating device.

14. An apparatus according to claim 11, further comprising an intervening member for intervening between said main body and said accommodating means to assist transfer of the developing devices therebetween.

15. An apparatus according to claim 11, further comprising a control member for limiting the vertical movement of said accommodating device.

16. An apparatus according to claim 15, wherein said controlling member is in the form of worm gear mechanism, step gears, solenoid or mechanical stopper.

17. An apparatus according to claim 11, further comprising a member for collecting developer falling from the developing devices, said member being disposed at a lower position between said main body and said accommodating device.

18. An apparatus according to claim 17, further comprising means for feeding a sheet into said main body, wherein said collecting member is disposed above said feeding means.

19. An apparatus according to claim 11, wherein said main body is provided with a developing device guide along said conveying passage, and wherein said accommodating device is provided with a developing device guides adapted to be aligned with said guide of the main body, and wherein the portions of the respective guides near the other are provided with inclined surface to provide expanded guides.

20. An apparatus according to claim 11, wherein said conveying passage and an outlet of said accommodating device are aligned by engagement between said main body and said accommodating device.

21. An apparatus according to claim 11, wherein said first driving mechanism includes first and second conveying means at lateral sides of the developing device with respect to a movement direction of the developing devices to provide substantially the same driving forces to the sides of the developing devices.

22. An apparatus according to claim 21, said first driving mechanism includes gears meshable with an upper or lower surface of each of the developing devices, and wherein said second driving mechanism includes gears meshable with racks formed on the respective lateral vertical sides of each of the developing devices.

23. An apparatus according to claim 22, further comprising an additional developing device in said main body, which uses a one component developer and which is disposed above said conveying passage, and wherein the developing devices contained in said accommodating device use two component developer, and wherein the gear of said first driving mechanism is meshable with a rack formed on a bottom surface of each of the developing devices accommodatable in said accommodating device.

24. An apparatus according to claim 11 or 22, wherein said image forming apparatus is operable in a manual sheet mode, wherein when said accommodating case is at a lower position before the manual feed mode is selected, said accommodating case is shifted upwardly to allow the manual feed of the sheet upon selection of the manual feed mode.

25. An apparatus according to claim 11, wherein said driving means performs at least two drive transmission functions from a single driving source.

26. An apparatus according to claim 25, wherein said driving means comprises a switching means for effecting selective drive transmission.

27. An apparatus according to claim 11, further comprising means for manually feeding a sheet into said main body, wherein at least one of driving mechanisms and said manual feeding means are driven by a common driving source, and wherein there is provided means for switching drive transmission from the driving source.

28. An apparatus according to claim 11, further comprising urging means, selectively disposed in or out of said conveying passage, for urging one of said developing devices upon urging operation and for retracting out of said conveying passage upon urge releasing operation.

29. An apparatus according to claim 11, wherein said first driving mechanism includes conveying means for conveying between said accommodating device and a stand-by position in said main body, said image forming apparatus further comprising means for urging the developing device existing at the stand-by position to an operative position, and wherein said developing device and said conveying means are in engagement when it is at the stand-by position, while the engagement is released when it is at the operative position.

30. A developing device movable between a developing device accommodating apparatus and a main body of an image forming apparatus in a horizontal plane, comprising:

a developer container for containing a developer;

a movable developer carrying member for carrying the developer out of said container to a developing zone where said developer carrying member is opposed or contacted to said image forming means and for carrying a remaining developer back into the developer container;

a casing;

said developing device being movable in a direction when it is supplied into the image forming apparatus from the accommodating apparatus;

a rack formed in both of lateral sides thereof with respect to movement direction of said developing device; and a rack formed on an upper or bottom surface of said developing device.

31. A device according to claim 30, further comprising a projection for being guided by a concave portion of the main body.

32. A device according to claim 31, wherein said projection comprises plural projections arranged in plural lines along the movement direction.

33. An apparatus for accommodating a plurality of developing devices, comprising:

an accommodating case movable in a first direction, including plural partition stages for movably accommodating the plural developing devices;

a moving mechanism for engaging with a selected one of the developing devices on the partition stages to move the selected developing device relative to the partition stage in a direction crossing with the first direction;

means for detecting colors of the developers contained in the developing devices; and means for mounting said accommodating apparatus to an image forming apparatus with which said accommodating apparatus is used.

34. An apparatus for accommodating a plurality of developing devices, comprising:

an accommodation case movable in a first direction, including plural partition stages arranged in the first direction for movably accommodating the plural developing devices;

a moving mechanism for engaging with a selected one of the developing devices on the partition stage to move the selected developing device relative to the partition stage in a second direction crossing with the first direction; and means for mounting said accommodating apparatus to an image forming apparatus with which said accommodating apparatus is used;

wherein each of said developing devices accommodated in said accommodation apparatus is provided with racks at respective lateral sides thereof with respect to a movement direction of the developing devices, wherein said moving mechanism includes drive transmission gears which are meshable with the racks.

35. An image forming apparatus, comprising:

an image bearing member;

means for forming an electrostatic latent image on said image bearing member;

a conveying passage extending toward said image bearing member to guide a developing device;

a first moving mechanism for engaging with the developing device in said conveying passage and moving it along the conveying passage;

said image bearing member, said latent image forming means, said conveying passage and said first moving mechanism being provided in a main body of said image forming apparatus;

a device for accommodating a plurality of developing devices, said accommodating device being detachably mountable to said main body, said accommodating device including:

a second moving mechanism for moving the developing device opposed to said conveying passage into said conveying passage in a first direction and an accommodating case having partition stages arranged in a second direction crossing with the first direction for accommodating plural developing devices and movable together with the developing devices accommodated therein; and driving means for transmitting a driving force selectively to said first driving mechanism, said second driving mechanism and said accommodating case.

36. An image forming apparatus, comprising:

an image bearing member;

means for forming an electrostatic latent image on said image bearing member;

a conveying passage extending toward said image bearing member to guide a developing device;

a first moving mechanism for engaging with the developing device in said conveying passage and moving it along a conveying passage;

said image bearing member, said latent image forming means, said conveying passage and said first moving mechanism being provided in a main body of said image forming apparatus;

a device for accommodating a plurality of developing device, said accommodating device being detachably mountable to said main body, said accommodating device including:

a second moving mechanism for moving the developing device opposed to said conveying passage into said conveying passage in a first direction, and an accommodating case having partition stages arranged in a direction crossing with the first direction for accommodating plural developing devices and movable together with the developing devices accommodated therein; and wherein said main body is provided with a developing device guide along said conveying passage, and wherein said accommodating device is provided with a developing device guide adapted to be aligned with said guide of the main body, and wherein the portions of the respective guides near each other are provided with inclined surfaces to provided expanded guides.

37. An image forming apparatus, comprising:

said image bearing member;

means for forming an electrostatic latent image on said image bearing member;

a conveying passage extending toward said image bearing member to guide a developing device;

a first moving mechanism for engaging with the developing device in said conveying passage and moving it in the conveying passage;

said image bearing member, said latent image forming means, said conveying passage and said first moving mechanism being provided in a main body of said image forming apparatus;

a device for accommodating a plurality of developing devices, said accommodating device being detachably mountable to said main body, said accommodating device including:

a second moving mechanism for moving the developing device opposed to said conveying passage into said conveying passage in a first direction and an accommodating case having partition stage arranged in a second direction crossing with the first direction for accommodating plural developing devices and movable together with the developing devices accommodated therein; and wherein said main body further comprises urging means, selectively disposed in or out of said conveying passage, for urging one of said developing devices toward said image bearing member upon an urging operation and for retracting out of said conveying passage upon releasing the urging operation.

* * * * *

UNITED STATES PATENT AND TRADEMARK OFFICE

CERTIFICATE OF CORRECTION

PATENT NO. : 4,941,018

DATED : July 10, 1990

INVENTOR(S) : TOSHIROU KASAMURA ET AL.

It is certified that error appears in the above-identified patent and that said Letters Patent is hereby corrected as shown below:

ON THE TITLE PAGE:

AT [30] FOREIGN APPLICATION PRIORITY DATA

Insert, --Oct. 28, 1986 [JP] Japan.....61-256214
Oct. 28, 1986 [JP] Japan.....61-256215
Oct. 28, 1986 [JP] Japan.....61-256216
Oct. 28, 1986 [JP] Japan.....61-256217
Oct. 28, 1986 [JP] Japan.....61-256218
Nov. 07, 1986 [JP] Japan.....61-265095
Nov. 07, 1986 [JP] Japan.....61-265097
Nov. 11, 1986 [JP] Japan.....61-268386
Nov. 11, 1986 [JP] Japan.....61-268389
Nov. 11, 1986 [JP] Japan.....61-268390
Nov. 18, 1986 [JP] Japan.....61-274585
Nov. 18, 1986 [JP] Japan.....61-274586
Mar. 10, 1987 [JP] Japan.....62-052902
Jun. 29, 1987 [JP] Japan.....62-159816
Jul. 07, 1987 [JP] Japan.....62-167920
Jul. 07, 1987 [JP] Japan.....62-167921
Jul. 10, 1987 [JP] Japan.....62-171181--.

COLUMN 1

Line 26, "that" should be deleted.

COLUMN 3

Line 15, "device." should read --devices.--.
Line 59, "FIGS. 14-17" should read --FIGS. 15-17--.

COLUMN 8

Line 32, "a thin 133" should read --a pin 133--.

UNITED STATES PATENT AND TRADEMARK OFFICE

CERTIFICATE OF CORRECTION

PATENT NO. : 4,941,018

DATED : July 10, 1990

INVENTOR(S) : TOSHIROU KASAMURA ET AL.

It is certified that error appears in the above-identified patent and that said Letters Patent is hereby corrected as shown below:

COLUMN 11

Line 18, "for example" should be deleted.
Line 21, "so as to" should read --as in--.

COLUMN 12

Line 1, "any" should be deleted.
Line 67, "an" should read --and--.

COLUMN 14

Line 30, "(lack 511" should read --(rack 511--.

COLUMN 16

Line 38, "exist" should read --exists--.

COLUMN 18

Line 57, "a" should be deleted.

COLUMN 20

Line 55, "an" should be deleted.

COLUMN 30

Line 9, "guides" should read --guide--.

UNITED STATES PATENT AND TRADEMARK OFFICE

CERTIFICATE OF CORRECTION

PATENT NO. : 4,941,018

DATED : July 10, 1990

INVENTOR(S) : TOSHIROU KASAMURA ET AL.

It is certified that error appears in the above-identified patent and that said Letters Patent is hereby corrected as shown below:

OLUMN 32

Line 44, "device," should read --devices,--.

Signed and Sealed this

Second Day of April, 1996

Bruce Lehman

*Attest:*

BRUCE LEHMAN

*Commissioner of Patents and Trademarks*

*Attesting Officer*